US007537319B2

(12) United States Patent
Jung et al.

(10) Patent No.: US 7,537,319 B2
(45) Date of Patent: May 26, 2009

(54) PIEZOELECTRIC INKJET PRINTHEAD AND METHOD OF MANUFACTURING THE SAME

(75) Inventors: Chang-hoon Jung, Seoul (KR); Seung-mo Lim, Suwon-si (KR); Su-ho Shin, Seongnam-si (KR)

(73) Assignee: Samsung Electronics Co., Ltd., Suwon, Kyungki-do (KR)

( * ) Notice: Subject to any disclaimer, the term of this patent is extended or adjusted under 35 U.S.C. 154(b) by 63 days.

(21) Appl. No.: 11/356,063

(22) Filed: Feb. 17, 2006

(65) Prior Publication Data

US 2006/0181581 A1 Aug. 17, 2006

(30) Foreign Application Priority Data

Feb. 17, 2005 (KR) ..... 10-2005-0013141

(51) Int. Cl.
*B41J 2/045* (2006.01)
*B41J 2/17* (2006.01)

(52) U.S. Cl. ..... 347/68; 347/94

(58) Field of Classification Search ..... 347/70–72
See application file for complete search history.

(56) References Cited

U.S. PATENT DOCUMENTS 6,003,971 A 12/1999 Hanks et al.
6,905,202 B2 6/2005 Shimamoto et al.
7,303,271 B2 * 12/2007 Shimizu et al. ..... 347/94
2003/0112300 A1 6/2003 Chung et al.

FOREIGN PATENT DOCUMENTS

| | | |
|---|---|---|
| EP | 1 321 294 | 6/2003 |
| EP | 1 375 148 | 1/2004 |
| EP | 1 506 863 | 2/2005 |
| JP | 2003-237082 | 8/2003 |
| JP | 2005-014618 | 1/2005 |
| KR | 10-2003-0050477 | 6/2003 |
| KR | 2003-0050477 | 6/2003 |

* cited by examiner

*Primary Examiner*—Matthew Luu
*Assistant Examiner*—Lisa M Solomon
(74) *Attorney, Agent, or Firm*—Lee & Morse, P.C.

(57) ABSTRACT

A piezoelectric inkjet printhead, and a method of manufacturing the same, includes an ink inlet for allowing inflow of ink, a plurality of pressure chambers to contain ink to be ejected, the plurality of pressure chambers being in communication with the ink inlet, a manifold formed in communication with the ink inlet, a plurality of restrictors connecting the manifold to respective first ends of the pressure chambers, a plurality of dampers at positions corresponding to respective second ends of the pressure chambers, the second ends being opposite the first ends, a plurality of nozzles in communication with the plurality of dampers for ejecting the ink, a plurality of actuators for applying a driving force to each of the pressure chambers for ejecting the ink, a damping membrane under the manifold for dampening a pressure change inside the manifold and a cavity under the damping membrane.

30 Claims, 19 Drawing Sheets

PIEZOELECTRIC INKJET PRINTHEAD AND METHOD OF MANUFACTURING THE SAME

BACKGROUND OF THE INVENTION

1. Field of the Invention

The present invention relates to an inkjet printhead. More particularly, the present invention relates to a piezoelectric inkjet printhead having an improved structure for preventing cross-talk when ink is ejected, and a method of manufacturing the piezoelectric inkjet printhead.

2. Description of the Related Art

An inkjet printer is a device for forming an image on a medium by ejecting ink droplets onto a desired region of the medium. Inkjet printheads can be classified into two types according to the ejecting mechanism of ink droplets: a thermal type inkjet printhead that creates bubbles by heating the ink to eject ink droplets by the expansion of the bubbles, and a piezoelectric type inkjet printhead that includes a piezoelectric material to eject ink droplets by the pressure generated by the deformation of the piezoelectric material.

FIG. 1 illustrates a structure of a conventional piezoelectric inkjet printhead. Referring to FIG. 1, a manifold 2, a restrictor 3, a pressure chamber 4, and a nozzle 5 are formed in an ink flow plate 1 to form an ink path. A piezoelectric actuator 6 is installed on top of the ink flow plate 1. The manifold 2 supplies ink from an ink reservoir (not shown) to each pressure chamber 4. The restrictor 3 is an ink passage between the manifold 2 and the pressure chamber 4. The pressure chamber 4 receives the ink to be ejected and changes its volume in response to the operation of the piezoelectric actuator 6 to create a pressure variation for ejecting and receiving the ink. A top wall of the pressure chamber 4 deforms and returns to its original shape according to the operation of the piezoelectric actuator 6. The top wall is used as a vibration plate 1*a*.

When the vibration plate 1*a* is deformed by the piezoelectric actuator 6, the volume of the pressure chamber 4 decreases and the pressure of the pressure chamber 4 increases, such that ink contained in the pressure chamber 4 can be ejected through the nozzle 5. When the vibration plate 1*a* returns to its original shape according to the operation of the piezoelectric actuator 6, the volume of the pressure chamber 4 increases and the pressure of the pressure chamber 4 decreases, such that ink can be supplied to the pressure chamber 4 from the manifold 2 through the restrictor 3.

In the conventional inkjet printhead, the ink flow plate 1 is generally formed of a plurality of thin ceramic, metal, or synthetic plates. The thin plates are individually processed to have shapes corresponding to the ink flow path of the ink flow plate 1, and then the thin plates are stacked and bonded to form the ink flow plate 1. Since the plurality of thin plates is aligned through many operations, alignment errors increase and the manufacturing process of the inkjet printhead is complicated. The alignment errors cause non-smooth ink flow and lower the ink ejecting performance of the inkjet printhead. Particularly, since recent printheads have a highly integrated structure for high resolution, precise aligning becomes more important in the manufacturing process of the printhead. The precise aligning may increase the price of the printhead.

In addition, since the thin plates of the printhead are formed of different materials using different methods, the manufacturing process of the printhead is complicated and it is difficult to bond the thin plates, thereby decreasing the yield of the printhead. Further, since the thin plates of the printhead are formed of different materials, the alignment of the thin plates may be distorted or the thin plates may be deformed according to temperature changes due to different thermal expansion characteristics of the thin plates, even if the thin plates are precisely aligned and bonded together in manufacturing process.

One solution is a piezoelectric inkjet printhead illustrated in FIGS. 2 and 3. Referring to FIGS. 2 and 3, the piezoelectric inkjet printhead has a stacked structure formed by stacking and bonding three silicon substrates 30, 40 and 50.

An upper substrate 30 includes pressure chambers 32 formed in a bottom surface to a predetermined depth and an ink inlet 31 formed through one side for connection with an ink reservoir (not shown). The pressure chambers 32 are arranged in two lines along both sides of a manifold 41 formed in a middle substrate 40. Piezoelectric actuators 60 are formed on a top surface of the upper substrate 30 to apply driving forces to the pressure chambers 32 for ejecting ink. A vibrating plate 33 above the pressure chambers 32 is deformed by the operation of the piezoelectric actuators 60.

The middle substrate 40 includes the manifold 41 connected with the ink inlet 31 and a plurality of restrictors 42 formed on both sides of the manifold 41 in connection with the respective pressure chambers 32. A barrier rib 44 is formed in the manifold 41 to prevent cross-talk between the pressure chambers 32 arranged in two lines along both sides of the manifold 41. The middle substrate 40 further includes dampers 43 formed therethrough in a vertical direction at positions corresponding to the pressure chambers 32 formed in the upper substrate 30.

A lower substrate 50 includes nozzles 51 connected with the dampers 43.

As described above, the piezoelectric inkjet printhead shown in FIGS. 2 and 3 is configured by stacking the three substrates 30, 40, and 50. Thus, since the number of the substrates of the piezoelectric inkjet printhead shown in FIGS. 2 and 3 is less than that of the conventional piezoelectric inkjet printhead, the manufacturing process of the piezoelectric inkjet printhead is simpler and the aligning errors are reduced when the substrates are stacked.

However, when the vibrating plate 33 above the pressure chambers 32 is deformed by the operation of the piezoelectric actuators 60, to eject ink through the nozzles 51, the ink simultaneously flows into the manifold 41 through the restrictors 42. Due to this reverse flow of the ink, the pressure in the manifold 41 may increase non-uniformly. When the vibrating plate 33 returns to its original shape, the ink contained in the manifold 41 may suddenly flow into the pressure chambers 32 through the restrictors 42. Thus, the pressure of the manifold 41 may decrease non-uniformly.

When the pressure inside the manifold 41 changes suddenly and non-uniformly as described above, the pressure chambers 32 adjacent to the manifold 41 are affected by the pressure change of the manifold 41, thereby causing cross-talk between the pressure chambers 32. Meanwhile, although the barrier rib 44 formed in the manifold 41 can prevent cross-talk between the two pressure chamber lines arranged along both sides of the manifold 41, the barrier rib 44 cannot prevent cross-talk between the pressure chambers 32 within each pressure chamber line. If cross-talk occurs when ink is ejected as described above, ink ejecting speed and volumes of ink droplets vary undesirably.

FIG. 4 illustrates speed of ink ejected through a single nozzle in comparison with speed of ink ejected through a plurality of nozzles in the piezoelectric inkjet printhead depicted in FIGS. 2 and 3.

Referring to FIG. 4, when ink is ejected through a single nozzle, as shown in the left side of FIG. 4, the ejected ink droplet reaches a desired position indicated by a solid line since cross-talk between nozzles does not occur almost at all.

However, when ink is ejected through a plurality of nozzles, as shown in the right side of FIG. 4, the ejected ink droplets do not reach a desired position indicated by a solid line due to cross-talk between the nozzles. That is, the ink ejecting speed of a single nozzle is different from the ink ejecting speed of a plurality of nozzles.

As described above, if cross-talk occurs when ink is ejected, ink cannot be ejected uniformly, thus decreasing printing quality.

SUMMARY OF THE INVENTION

The present invention is therefore directed to a piezoelectric inkjet printhead and method of manufacturing the same, which overcome one or more of the problems noted above in the related art.

It is therefore a feature of an embodiment of the present invention to provide a piezoelectric inkjet printhead that includes a damping membrane formed under a manifold to dampen a sudden pressure change inside the manifold for preventing cross-talk when ink is ejected, and a method of manufacturing the piezoelectric inkjet printhead.

It is another feature of an embodiment of the present invention to provide a piezoelectric inkjet printhead, and a method of manufacturing the piezoelectric inkjet printhead, that is simpler to construct.

At least one of the above and other features and advantages of the present invention may be realized by providing a piezoelectric inkjet printhead including an ink inlet for allowing inflow of ink, a plurality of pressure chambers to contain ink to be ejected, the plurality of pressure chambers being in communication with the ink inlet, a manifold formed in communication with the ink inlet, a plurality of restrictors connecting the manifold to respective first ends of the pressure chambers, a plurality of dampers at positions corresponding to respective second ends of the pressure chambers, the second ends being opposite the first ends, a plurality of nozzles in communication with the plurality of dampers for ejecting the ink, a plurality of actuators for applying a driving force to each of the pressure chambers for ejecting the ink, a damping membrane under the manifold for dampening a pressure change inside the manifold and a cavity under the damping membrane.

The damping membrane may have a thickness of about 10 μm to about 20 μm. The cavity may extend to an edge of the printhead. The cavity may have substantially the same width as the manifold. The cavity may have a width larger than the manifold.

The ink inlet and the plurality of pressure chambers may be in an upper substrate. The manifold, the plurality of restrictors, the plurality of dampers and the damping membrane may be in a middle substrate. The plurality of nozzles may be in a lower substrate. The cavity may be in at least one of a bottom surface of the middle substrate and a top surface of the lower substrate. The cavity may extend to an edge of the at least one of the bottom surface of the middle substrate and the top surface of the lower substrate.

A full extent of the cavity may be defined in one of the middle substrate and the lower substrate. The piezoelectric inkjet printhead may include a barrier rib in the manifold along a length direction of the manifold and a supporting rib in the cavity along a length direction of the cavity in correspondence with the barrier rib.

At least one of the above and other features and advantages of the present invention may be realized by providing a piezoelectric inkjet printhead including an ink inlet for allowing inflow of ink, a plurality of pressure chambers to contain ink to be ejected, the plurality of pressure chambers being in communication with the ink inlet, a manifold formed in communication with the ink inlet, a barrier rib in the manifold along a length direction of the manifold, a plurality of restrictors connecting the manifold to respective first ends of the pressure chambers, a plurality of dampers at positions corresponding to respective second ends of the pressure chambers, the second ends being opposite the first ends, a plurality of nozzles in communication with the plurality of dampers for ejecting the ink, a plurality of actuators for applying a driving force to each of the pressure chambers for ejecting the ink and a dampening unit for dampening a pressure change inside the manifold.

The dampening unit may include a damping membrane under the manifold and a cavity under the damping membrane.

At least one of the above and other features and advantages of the present invention may be realized by providing a method of manufacturing a piezoelectric inkjet printhead including forming an ink inlet allowing inflow of ink, forming a plurality of pressure chambers to contain ink to be ejected, forming a manifold in communication with the ink inlet, forming a plurality of restrictors connecting the manifold to respective first ends of the pressure chambers, forming a plurality of dampers at positions corresponding to respective second ends of the pressure chambers, the second ends being opposite the first ends, forming a damping membrane under the manifold for dampening pressure change inside the manifold, forming a cavity under the damping membrane, forming a plurality of nozzles for ejecting the ink and forming a plurality of piezoelectric actuators for providing a driving force for ejecting the ink.

The damping membrane may have a thickness of about 10 μm to about 20 μm. The cavity may extend to an edge of the printhead. The cavity may have substantially the same width as the manifold. The cavity may have a width larger than the manifold.

The method may further include forming a barrier rib in the manifold along a length direction of the manifold and forming a supporting rib in the cavity along a length direction of the cavity in correspondence with the barrier rib.

Forming the ink inlet and the plurality of pressure chambers may include processing an upper silicon substrate. Forming the manifold, the plurality of restrictors, the plurality of dampers and the damping membrane may include processing a middle silicon substrate. Forming the plurality of nozzles may include processing a lower silicon substrate. Forming the cavity may include processing at least one of the middle and lower substrates.

Each of processing of the middle substrate and processing of the lower substrate may include forming an aligning mark for using the aligning mark as an aligning reference in stacking and bonding the lower substrate and the middle substrate and the cavity is simultaneously formed with the aligning mark in at least one of the middle substrate and the lower substrate.

Forming the cavity and the aligning mark may include forming a silicon oxide layer on at least one surface of the bottom surface of the middle substrate and the top surface of the lower substrate, forming a photoresist on the silicon oxide layer and patterning the photoresist to form openings for the cavity and the aligning mark, etching the silicon oxide layer exposed through the openings to expose the at least one surface and etching the at least one surface exposed by the etching of the silicon oxide layer to a predetermined depth to form the cavity and the aligning mark.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF THE INVENTION

Figure 1:
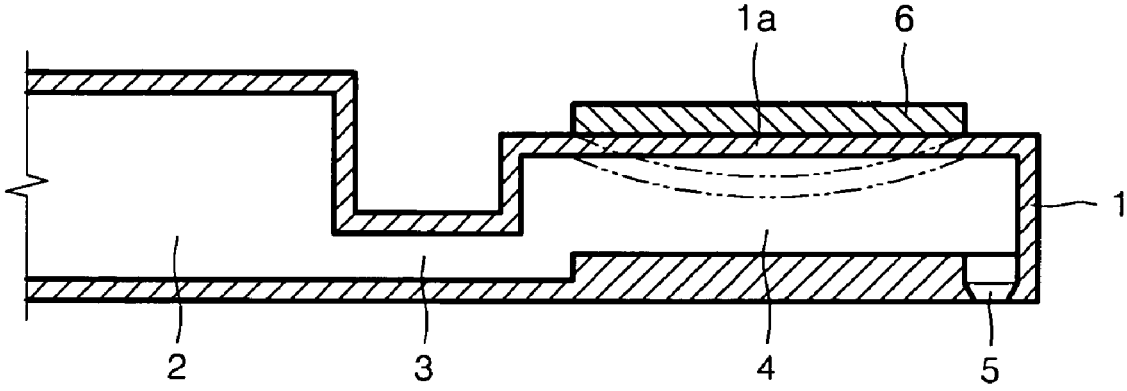
FIG. 1 (PRIOR ART)
FIG. 1 illustrates a schematic sectional view of a structure of a conventional piezoelectric inkjet printhead.
Figure 2:
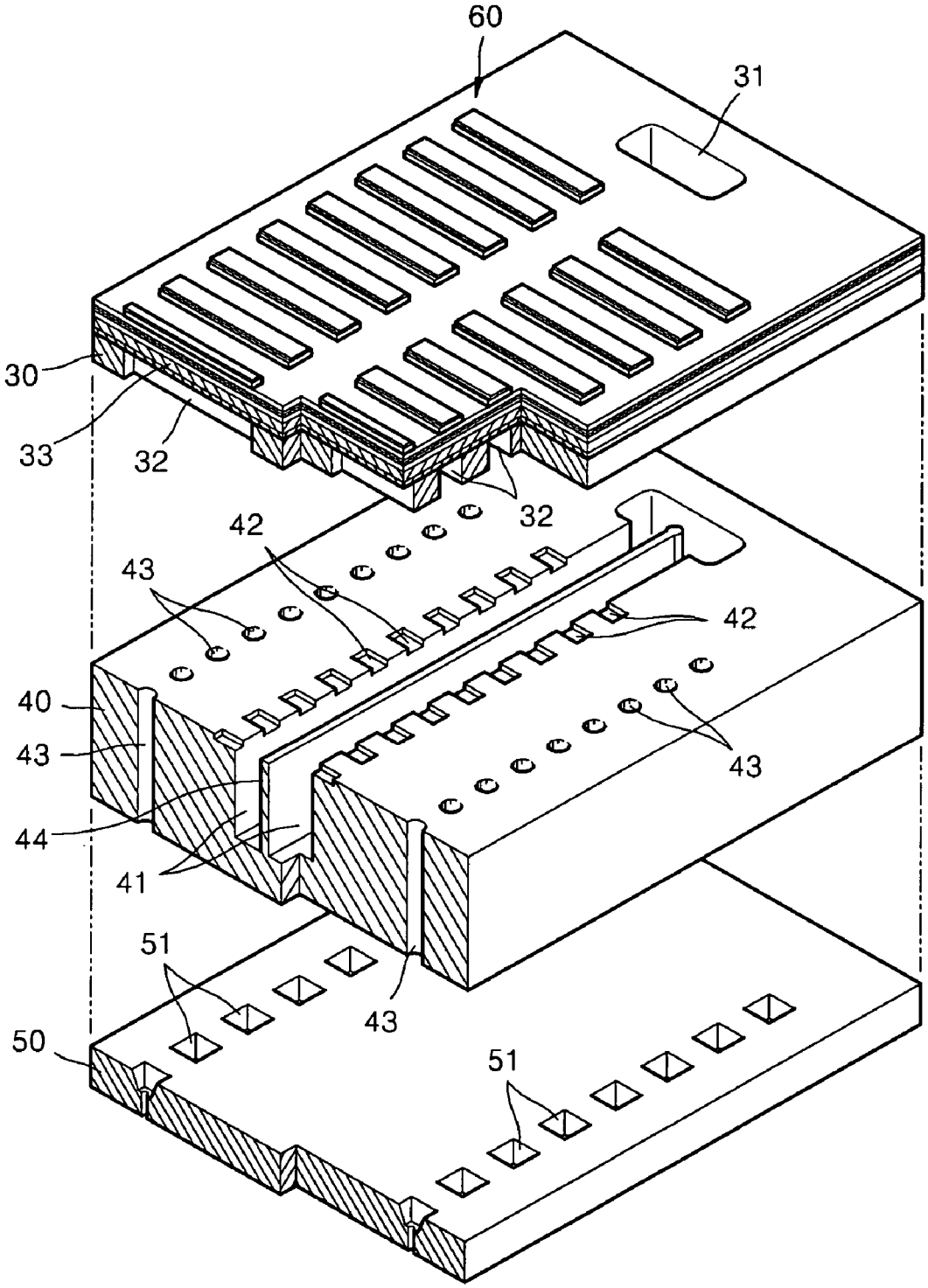
FIG. 2 (PRIOR ART)
FIG. 2 illustrates an exploded perspective view of a specific example of a conventional piezoelectric printhead.
Figure 3:
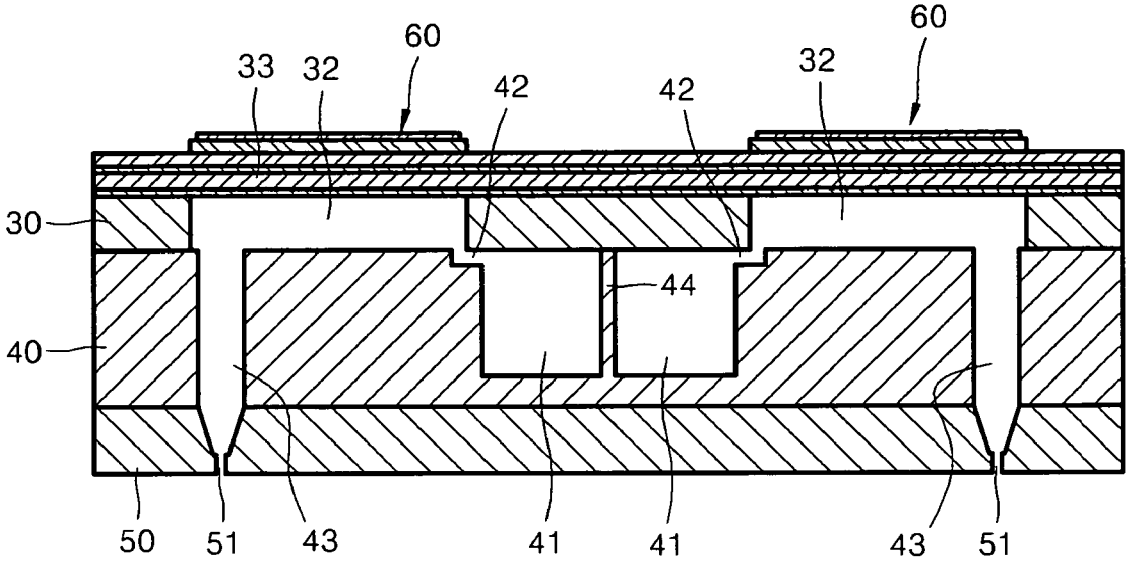
FIG. 3 (PRIOR ART)
FIG. 3 illustrates a vertical sectional view of the piezoelectric inkjet printhead depicted in FIG. 2.
Figure 4:
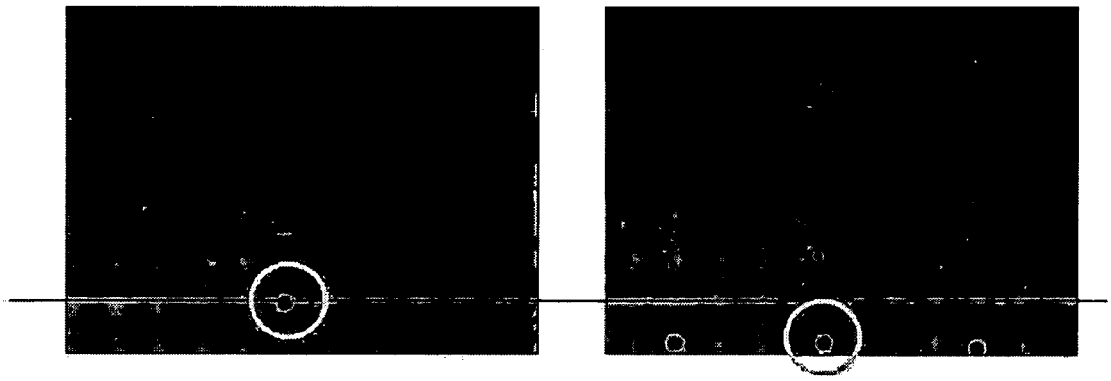
FIG. 4 (PRIOR ART)
FIG. 4 illustrates speed of ink ejected through a single nozzle in comparison with speed of ink ejected through a plurality of nozzles in the piezoelectric inkjet printhead depicted in FIGS. 2 and 3.

Korean Patent Application No. 10-2005-0013141, filed on Feb. 17, 2005, in the Korean Intellectual Property Office, and entitled: "Piezoelectric Inkjet Printhead and Method of Manufacturing the Same," is incorporated by reference herein in its entirety.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the figures, the dimensions of layers and regions are exaggerated for clarity of illustration. It will also be understood that when a layer is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

Figure 5:
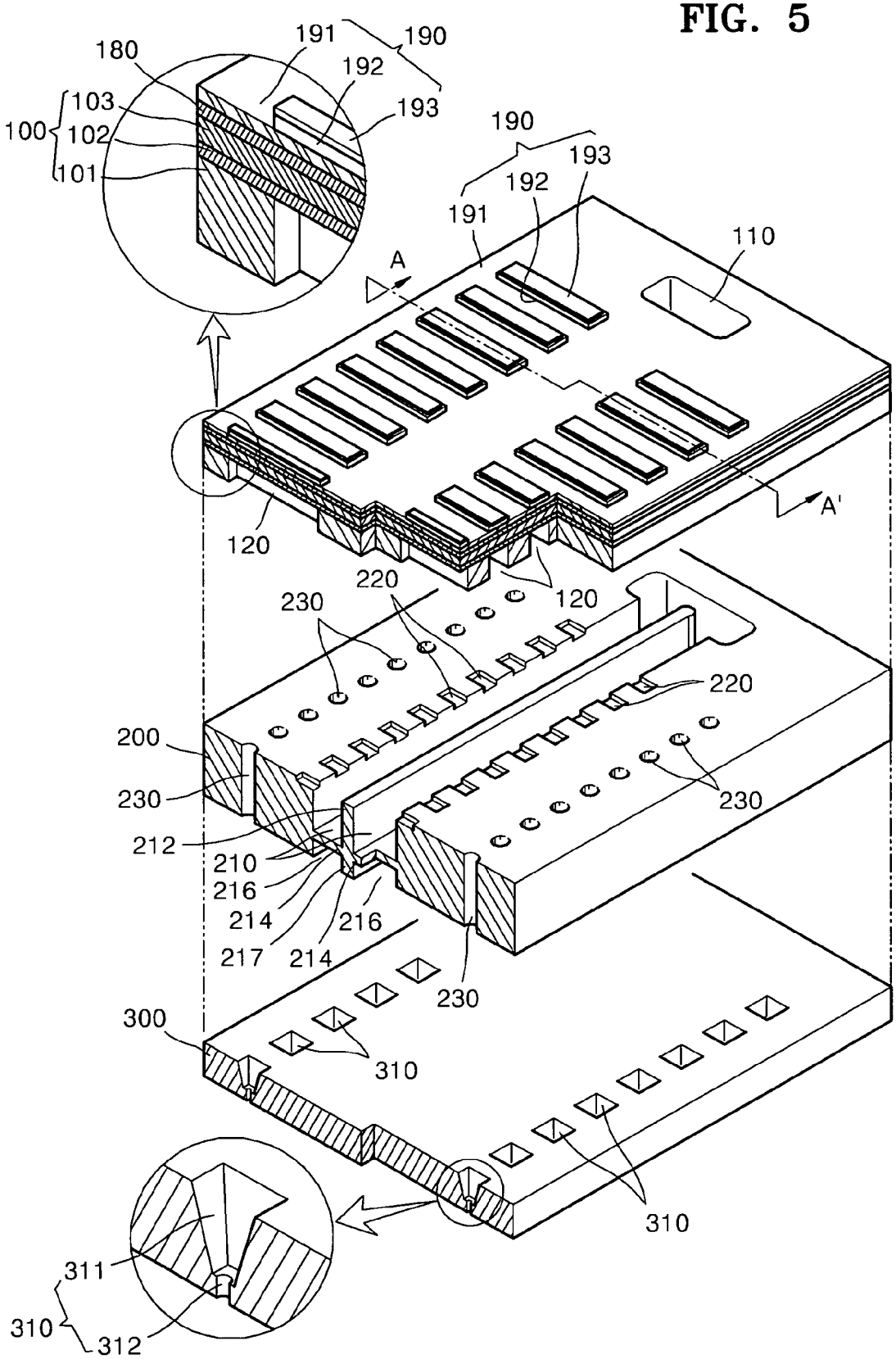
FIG. 5 illustrates an exploded cut-away view of a piezoelectric inkjet printhead according to an embodiment of the present invention.
Figure 6:
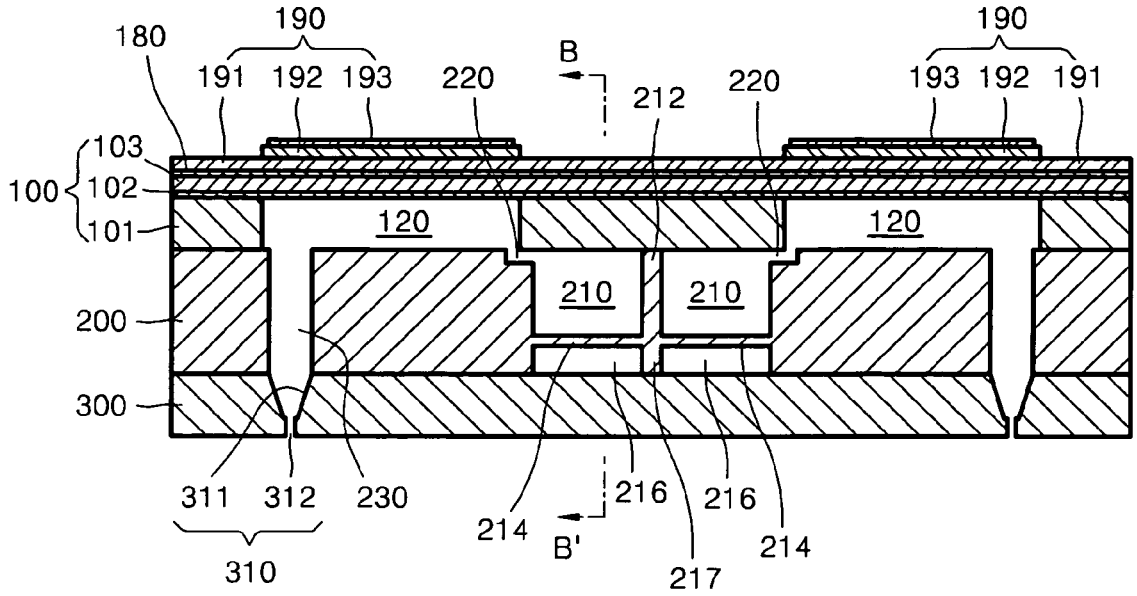
FIG. 6 illustrates a sectional view taken along line A-A' of FIG. 5.
Figure 7:
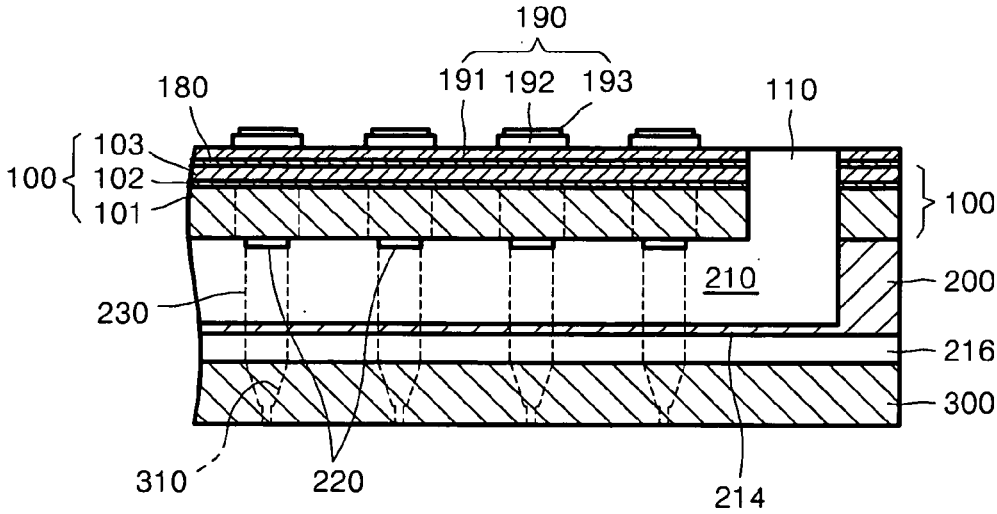
FIG. 7 illustrates a sectional view taken along line B-B' of FIG. 6.

FIG. 5 illustrates a partial exploded perspective view of a piezoelectric inkjet printhead according to an embodiment of the present invention, FIG. 6 illustrates a sectional view taken along line A-A' of FIG. 5, and FIG. 7 illustrates a sectional view taken along line B-B' of FIG. 6.

Referring to FIGS. 5 through 7, the piezoelectric inkjet printhead of an embodiment of the present invention may include three substrates, i.e., an upper substrate 100, a middle substrate 200 and a lower substrate 300, secured together. An ink passage may be formed in the three substrates 100, 200 and 300, and piezoelectric actuators 190 may be formed on a top surface of the upper substrate 100 for generating driving forces to eject ink.

Each of the three substrates 100, 200 and 300 may be formed of a single crystal silicon wafer. Therefore, elements of the ink passage may be formed more minutely, precisely, and easily than in substrates of other materials, e.g., using micromachining technologies such as photolithography and etching.

The ink passage may include an ink inlet 110 allowing inflow of ink from an ink reservoir (not shown), a plurality of ink chambers 120 containing the ink to be ejected and capable of being deformed for generating pressure variations, a manifold 210 as a common passage for distributing the ink coming through the inlet 110 to the respective ink chambers 120, restrictors 220 as individual passages for supplying the ink from the manifold 210 to the respective pressure chambers 120, and nozzles 310 through which the ink contained in the pressure chambers 120 is ejected. A damper 230 may be formed between the pressure chamber 120 and the nozzle 310 for concentrating a pressure generated in the pressure chamber 120 by the actuator 190 toward the nozzle 310 and absorbing a sudden change of the pressure. These elements of the ink passage may be distributed among the three substrates 100, 200 and 300.

Specifically, the upper substrate 100 may include the ink inlet 110 and the plurality of pressure chambers 120. The ink inlet 110 may penetrate the upper substrate 100 in a vertical direction and may be connected to an end of the manifold 210 formed in the middle substrate 200. Alternatively, two ink inlets 110 may be connected to both ends of the manifold 210. The plurality of pressure chambers 120 may be formed in a bottom of the upper substrate 100 and may have a rectangular shape having a length which exceeds a width of the manifold 210. The plurality of pressure chambers 120 may be arranged in two lines along both sides of the manifold 210 formed in the middle substrate 200. Alternatively, the plurality of pressure chambers 120 may be arranged in a line along one side of the manifold 210.

The upper substrate 100 may be formed of a single crystal silicon wafer that is widely used for manufacturing a semiconductor integrated circuit. The upper substrate 100 may be formed of a silicon-on-insulator (SOI) wafer. The SOI wafer may have a stacked structure with a first silicon layer 101, an intervening oxide layer 102 formed on the first silicon layer 101 and a second silicon layer 103 bonded to the intervening oxide layer 102. The first silicon layer 101 may be formed of a single crystal silicon and may have a thickness of about 100 μm to about 250 μm. The intervening oxide layer 102 may be formed by oxidizing the top surface of the first silicon layer 101. The intervening oxide layer 102 may have a thickness of about 2 μm. The second silicon layer 103 may also be formed of single crystal silicon and has a thickness of about 10 μm to about 20 μm. By using an SOI wafer for the upper substrate 100, the depth of the pressure chambers can be precisely adjusted. That is, when the pressure chambers 120 are formed, the intervening oxide layer 102 of the SOI wafer functions as an etch stop layer, such that the depth of the pressure chambers 120 can be determined by the thickness of the first silicon layer 101. Further, the second silicon layer 103 forming upper walls of the pressure chambers 120 may be deformable in response to the operations of the piezoelectric actuators 190. That is, the second silicon layer 103 may operate as a vibrating plate to change the volumes of the pressure chambers 120. The thickness of the vibrating plate thus may be determined by the thickness of the second silicon layer 103.

The piezoelectric actuators 190 may be formed on the upper substrate 100. A silicon oxide layer 180 may be formed between the upper substrate 100 and the piezoelectric actuators 190. The silicon oxide layer 180 may be used as an insulating layer. Further, the silicon oxide layer 180 may be used to prevent diffusion and thermal stress between the upper substrate 100 and the piezoelectric actuators 190. Each of the piezoelectric actuators 190 may include a lower electrode 191 used as a common electrode, a piezoelectric layer 192 capable of deforming according to an applied voltage, and an upper electrode 193 as a driving electrode. The lower electrode 191 may be formed on the entire surface of the silicon oxide layer 180. Though the lower electrode 191 can be configured with a single conductive metal layer, it may be configured with two thin metal layers formed of, e.g., titanium (Ti) and platinum (Pt). The lower electrode 191 may be used as a common electrode and a diffusion barrier layer for preventing inter-diffusion between the piezoelectric layers 192 and the upper substrate 100. The piezoelectric layers 192 may be formed on the lower electrode 191 above the respective pressure chambers 120. The piezoelectric layers 192 may be formed of a piezoelectric material, e.g., lead zirconate titanate (PZT) ceramic. When a sufficient voltage is applied to the piezoelectric layer 192, the piezoelectric layer 192 may be deformed to bend the second silicon layer 103 of the upper substrate 100 that forms the upper wall (vibrating plate) of the pressure chamber 120. The upper electrode 193 may be formed on the piezoelectric layer 192 as a driving electrode for applying a voltage to the piezoelectric layer 192.

The middle substrate 200 may be formed of a single crystal silicon wafer that is widely used for manufacturing a semiconductor integrated circuit. The middle substrate 200 may have a thickness of about 200 μm to about 300 μm. The middle substrate 200 may include the manifold 210 connected with the ink inlet 110 and the plurality of restrictors 220 connected between the manifold and ends of the plurality of pressure chambers 120. The middle substrate 200 may include the plurality of dampers 230 connecting the plurality of pressure chambers 120 to the plurality of nozzles 310 (described in detail later) formed in the lower substrate 300. The middle substrate 200 may further include a damping membrane 214 formed under the manifold 210 and a cavity 216 formed under the damping membrane 214.

The manifold 210 may be defined in the top surface of the middle substrate 200 to a predetermined depth. The manifold 210 may be elongated in one direction. As described above, in the case where the plurality of pressure chambers 120 are arranged in two lines along both sides of the manifolds 210, a long barrier rib 212 may be formed in the manifold 210 in a length direction of the manifold 210 to divide the manifold 210 into right and left portions. The barrier rib 212 effectively prevents cross-talk between the two pressure chamber lines arranged along the two sides of the manifold 210.

The damping membrane 214 may be formed under the manifold 210 to dampen sudden pressure variations of the manifold 210. The thickness of the damping membrane 214 may range from about 10 μm to about 20 μm. If the damping membrane 214 is too thick, the damping membrane is not easily deformed, and if the damping membrane 214 is too thin, the damping membrane 214 is easily damaged or broken.

The cavity 216 may be formed under the damping membrane 214 to allow free deformation of the damping membrane 214. The cavity 216 may have substantially the same width as the manifold 210 formed on the damping membrane 214. A supporting rib 217 may be formed in the cavity 216 in correspondence with the barrier rib 212. The supporting rib 217 may support the damping membrane 214 to prevent excessive deformation and breakage of the damping membrane 214.

When the damping membrane 214 is covered by the lower substrate 300 bonded to the middle substrate 200, the damping membrane 214 is not exposed to the outside. Therefore, the damping membrane 214 can be prevented from breakage due to contact with an external object.

Further, the cavity 216, as shown in FIG. 7, may extend to an edge of the middle substrate 200 for communicating with the outside. In contrast, if the cavity 216 is closed, the free deformation of the damping membrane 214 may be hindered by the pressure of the closed cavity 216. Further, if the cavity 216 is opened to the outside, gas generated during the bonding process of the middle substrate 200 and the lower substrate 300 can be easily discharged to the outside through the cavity 216, such that the formation of voids between the middle substrate 200 and the lower substrate 300 can be prevented. This will be more fully described below when presenting a method of manufacturing the piezoelectric inkjet printhead.

As described above, according to an embodiment of the present invention, the damping membrane 214 may be formed under the manifold 210 to dampen a sudden pressure change in the manifold 210, so that cross-talk can be effectively prevented between the plurality of pressure chambers 120 arranged in a line along a side of the manifold 210. Therefore, ink can be uniformly ejected through the plurality of nozzles 310, thus improving printing quality.

Each of the plurality of restrictors 220 may be formed in the top surface of the middle substrate 200 to a predetermined depth, e.g., about 20 μm to 40 μm. One end of the restrictor 220 may be connected to the manifold 210, and the other end of the restrictor 220 may be connected to one end of the pressure chamber 120. The restrictor 220 may control ink flow from the manifold 210 to the pressure chamber 120, such that ink can be supplied to the pressure chamber 210 at a proper rate. Further, when the ink is ejected, the restrictor 220 may prevent the ink from flowing in reverse from the pressure chamber 120 to the manifold 210. In another implementation, the restrictor 220 may be formed to have the same depth as the manifold 210 (not shown).

Each of the dampers 230 may be vertically defined through the middle substrate 200 at a position corresponding to the other end of each pressure chamber 120.

The lower substrate 300 may include the plurality of nozzles 310 to eject ink. The lower substrate 300 may be formed of a single crystal silicon wafer that is widely used for manufacturing a semiconductor integrated circuit, and may have a thickness of about 100 μm to about 200 μm.

Each of the plurality of nozzles 310 may be vertically formed through the lower substrate 300 at a position corresponding to the damper 230. The nozzle 310 may include an ink introducing portion 311 formed in an upper portion of the lower substrate 300 and an ink ejecting hole 312 formed in a lower portion of the lower substrate 300 for ejecting ink therethrough. The ink ejecting hole 312 may be a vertical hole having a uniform diameter, and the ink introducing portion 311 may have a pyramid shape with a gradually decreasing cross-section from the damper 230 to the ink ejecting hole 312.

As described above, the three substrates 100, 200 and 300 may be stacked and bonded together, thereby forming the piezoelectric inkjet printhead of the present invention. The ink passage in the three substrates 100, 200 and 300 may be formed by the sequential connection of the ink inlet 110, the manifold 210, the pressure chambers 120, the dampers 230, and the nozzles 310.

Figure 8A:
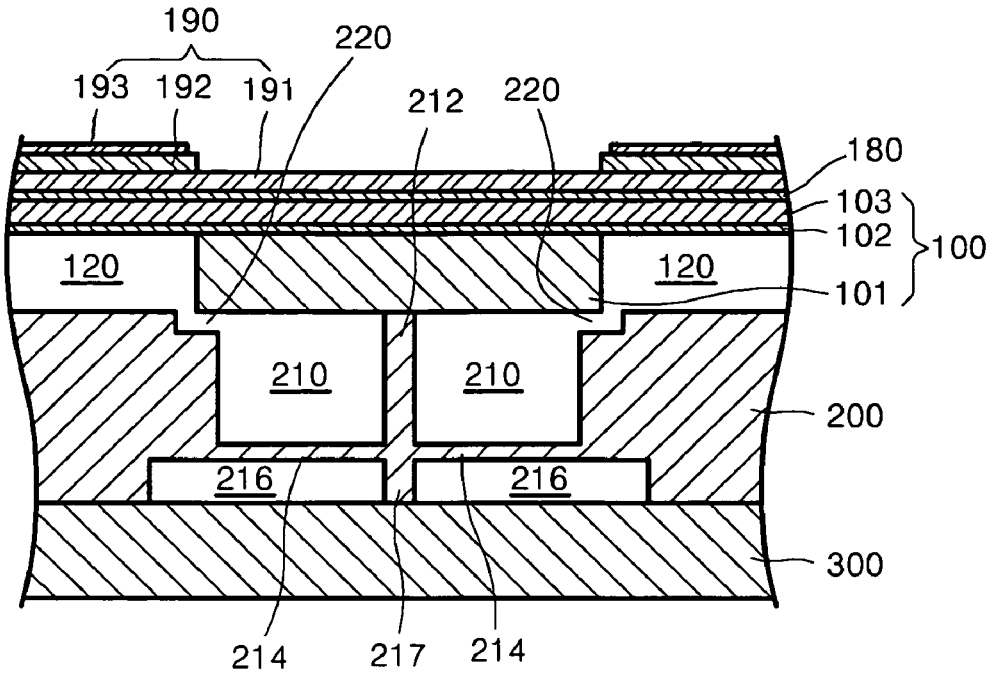
FIGS. 8A through 8C illustrate partial cross-sectional views of examples of a cavity of the piezoelectric inkjet printhead depicted in FIG. 6 according to other embodiments of the present invention.
Figure 8B:
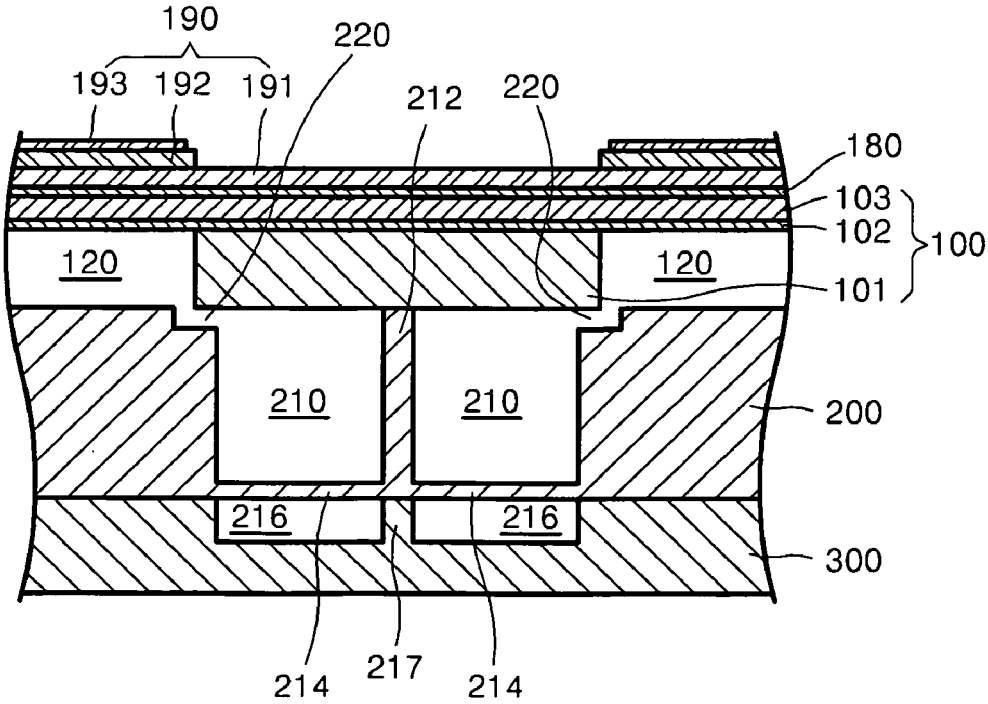
Figure 8C:
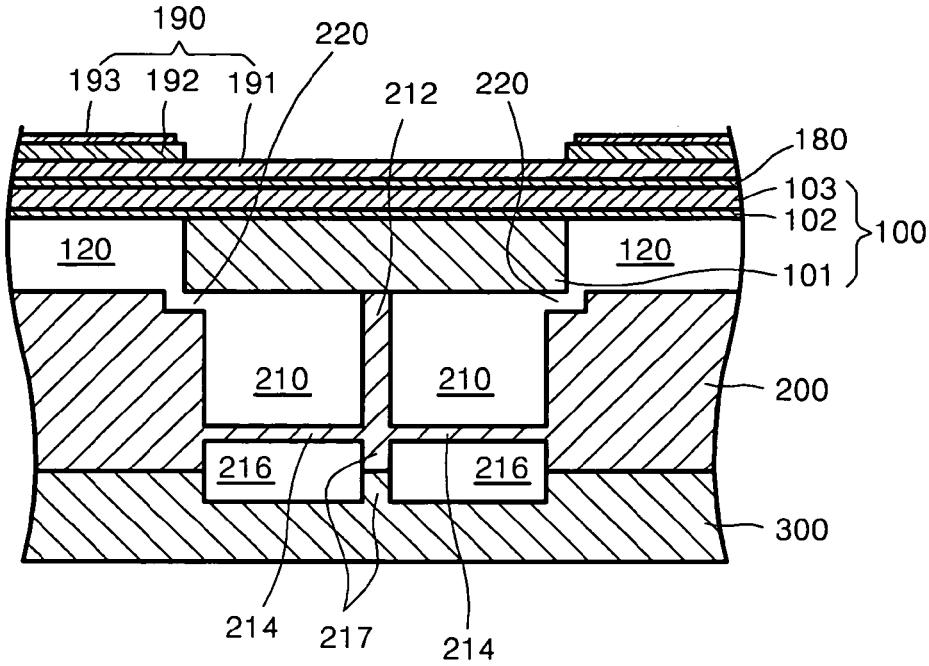

FIGS. 8A through 8C illustrate partial cross-sectional views showing examples of the cavity 216 formed in the piezoelectric inkjet printhead depicted in FIG. 6, according to embodiments of the present invention.

Referring to FIG. 8A, the cavity 216 can be formed to have a width larger than that of the manifold 210. In this case, gas generated when the middle substrate 200 and the lower substrate 300 are bonded can be more easily collected and discharged through the cavity 216.

Referring to FIG. 8B, the cavity 216 can be formed in the top surface of the lower substrate 300 to a predetermined depth instead of being formed in the bottom surface of the middle substrate 200. In this case, the supporting rib 217 is also formed on the top surface of the lower substrate 300. When the manifold has a comparatively large depth and the lower substrate 300 has a comparatively large thickness, the cavity 216 shown in FIG. 8B may be suitable.

Referring to FIG. 8C, the cavity 216 can be formed in the bottom surface of the middle substrate 200 and the top surface of the lower substrate 300. In this case, the supporting rib 217 may also be formed on the bottom surface of the middle substrate 200 and the top surface of the lower substrate 300. When a cavity cannot be formed in the bottom surface of the middle substrate 200 to a sufficient depth, the cavity 216 shown in FIG. 8C may be suitable.

As described above, at least one of the bottom surface of the middle substrate 200 and the top surface of the lower substrate 300 may be formed with the cavity 216 depending on the depth of the manifold 210 and the thicknesses of the middle substrate 200 and the lower substrate 300.

An operation of the piezoelectric inkjet printhead having the above-described structure will now be described according to the present invention.

Ink drawn into the manifold 210 from the ink reservoir (not shown) is supplied to the respective pressure chambers 120 through the plurality of restrictors 220. When the pressure chamber 120 is filled with the ink and a sufficient voltage is applied to the piezoelectric layer 192 through the upper electrode 193 of the piezoelectric actuator 190, the piezoelectric layer 192 is deformed to bend down the second silicon layer 103 (vibrating plate) of the upper substrate 100. The volume of the pressure chamber 120 decreases as the second silicon layer 103 is bent down. Thus the pressure of the pressure chamber 120 increases, such that the ink contained in the pressure chamber 120 can be ejected to the outside through the damper 230 and the nozzle 310.

When the voltage applied to the piezoelectric layer 192 of the piezoelectric actuator 190 is cut off, the piezoelectric layer 192 returns to its original shape, and as a result the second silicon layer 103 (vibrating layer) also returns to its original shape to increase the volume of the pressure chamber 120. As the volume of the pressure chamber 120 increases, the pressure of the pressure chamber 120 decreases, such that ink can be drawn into the pressure chamber 120 from the manifold 210 through the restrictor 220.

In this process, the pressure inside the manifold 210 changes very rapidly. However, according to an embodiment of the present invention, the damping membrane 214 may be provided under the manifold 210 to dampen the rapid pressure change of the manifold 210. Therefore, when ink is ejected, cross-talk can be effectively prevented and the ink can be uniformly ejected through the plurality of nozzles with constant performance, thereby improving printing quality of the piezoelectric inkjet printhead of the present invention.

A method of manufacturing the piezoelectric inkjet printhead having the above-mentioned structure will now be described according to an embodiment of the present invention.

Briefly, the upper substrate, the middle substrate and the lower substrate in which the elements forming the ink passage are included may be individually fabricated, and then the three substrates may be stacked and bonded together. After that, the piezoelectric actuators may be formed on the upper substrate, thereby completing the manufacturing of the piezoelectric inkjet printhead of the present invention. The upper substrate, the middle substrate and the lower substrate may be fabricated in any suitable order. That is, the lower substrate or the middle substrate may be fabricated prior to other substrates, or two or three substrates may be fabricated at the same time. However, fabrication of the respective substrates will now be described in the upper, middle, and lower substrate order as an example.

FIGS. 9A through 9D illustrate cross-sectional views of stages in a method of forming alignment marks in a top surface and a bottom surface of the upper substrate 100 during manufacturing of the piezoelectric inkjet printhead depicted in FIG. 6, according to an embodiment of the present invention.

Figure 9A:
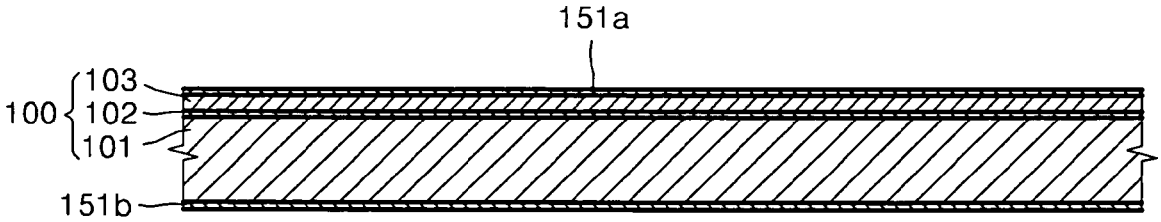
FIGS. 9A through 9D illustrate cross-sectional views of stages in a method of forming alignment marks in a top surface and a bottom surface of an upper substrate in a method of manufacturing the piezoelectric inkjet printhead depicted in FIG. 6 according to an embodiment of the present invention.

Referring to FIG. 9A, the upper substrate 100 may be formed of a single crystal silicon wafer. Since a single crystal silicon wafer, which is widely used for manufacturing a semiconductor device, can be directly used, it is advantageous for the mass production of the upper substrate 100. Further, the upper substrate 100 may be formed of an SOI wafer for precisely forming the pressure chamber 120 at a predetermined depth. The SOI wafer, as described above in connection with FIGS. 5 and 6, has the stacked structure with the first silicon layer 101, the intervening oxide layer 102 formed on the first silicon layer 101 and the second silicon layer 103 on the intervening oxide layer 102.

The first silicon layer 101 may have a thickness of about 650 μm, the intervening oxide layer 102 may have a thickness of about 2 μm and the second silicon layer 103 may have a thickness of about 10 μm to 20 μm. The thickness of the first silicon layer 101 of the upper substrate 100 may be decreased by chemical-mechanical polishing (CMP), and then the entire surface of the upper substrate 100 may be cleaned. Here, the thickness of the first silicon layer 101 may be reduced to a proper thickness in accordance with the thickness of the pressure chamber 120 to be formed. For example, the thickness of the first silicon layer 101 may be reduced to a thickness ranging from about 100 μm to about 250 μm. Further, the upper substrate 100 may be cleaned by an organic cleaning method using acetone, isopropyl alcohol, etc., or an acid cleaning method using sulfuric acid, buffered oxide etchant (BOE), etc, or an SC1 cleaning method.

After the cleaning, the upper substrate 100 may be wet and dry oxidized to form silicon oxide layers 151*a* and 151*b* on top and bottom surfaces. The silicon oxide layers 511*a* and 151*b* may have a thickness of about 5,000 Å to about 15,000 Å.

Figure 9B:
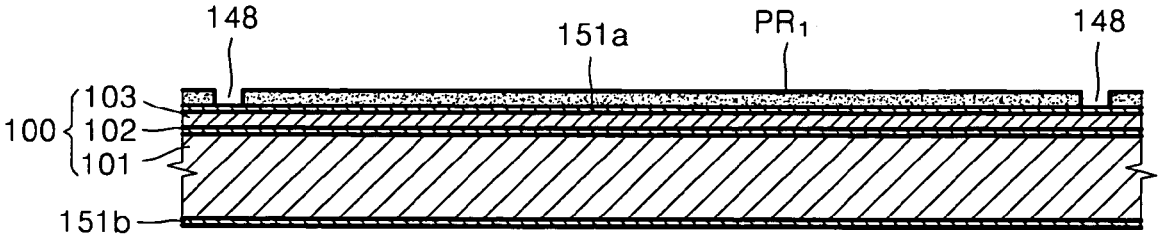

Referring to FIG. 9B, a photoresist $PR_1$ may be formed on the silicon layer 151*a* formed on the top surface of the upper substrate 100. Next, openings 148, in which aligning marks 141, shown in FIG. 9C, may be formed, may be formed on the photoresist $PR_1$ by patterning the photoresist $PR_1$. The patterning of the photoresist $PR_1$ may be performed using a well-known photolithography method including exposing and developing. Other photoresists described below may be patterned using the same method.

Figure 9C:
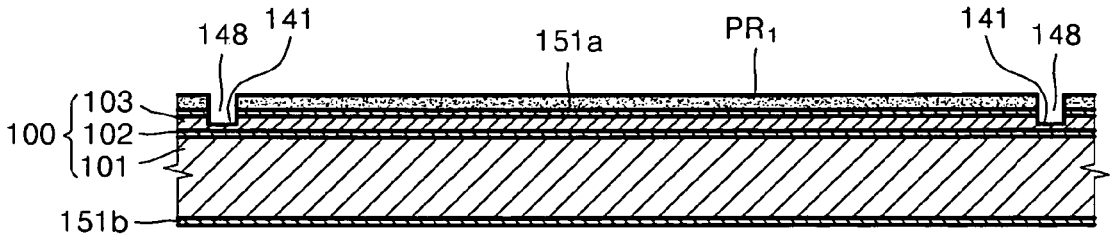

Referring to FIG. 9C, the silicon oxide layer 151*a* may be etched using the patterned photoresist $PR_1$ as an etch mask to remove exposed portions of the silicon oxide layer 151*a* by the patterned photoresist $PR_1$. Consecutively, the upper substrate 100 may be etched by a predetermined depth to form the aligning marks 141. Here, the etching of the silicon oxide layer 151*a* may be performed by a dry etching method, e.g., reactive ion etching (RIE), or a wet etching method, e.g., using BOE. The etching of the upper substrate 100 may be performed by a dry etching method, e.g., RIE using inductively coupled plasma (ICP), or a wet etching method. e.g, using a silicon etchant such as tetramethyl ammonium hydroxide (TMAH) or potassium hydroxide (KOH).

Next, the photoresist $PR_1$ may be removed using the organic cleaning method or the acid cleaning method described above. Alternatively, the photoresist $PR_1$ may be removed by ashing. Other photoresists described below may be removed using the same methods.

Although the photoresist $PR_1$ is described above as being removed after the silicon oxide layer 151*a* and the upper substrate 100 are etched, the photoresist $PR_1$ can be removed after the silicon oxide layer 151*a* is etched using the photoresist $PR_1$ as an etch mask, and then the upper substrate 100 can be etched using the etched silicon oxide layer 151*a* as an etch mask.

Figure 9D:
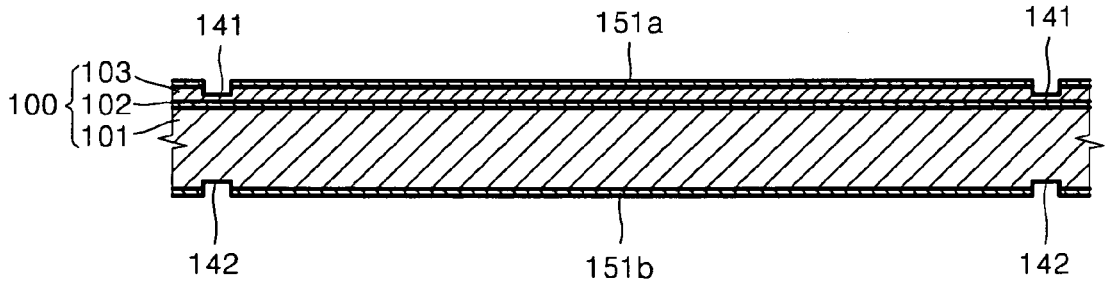

Referring to FIG. 9D, aligning marks 142 may be formed on the bottom surface of the upper substrate 100 according to the same method described above.

FIGS. 10A through 10D illustrate cross-sectional views of stages in a method of forming a pressure chamber and an ink inlet in the upper substrate 100.

Referring to FIG. 1A, a photoresist $PR_2$ may be formed on the silicon oxide layer 151*b* formed on the bottom surface of the upper substrate 100. Then, the photoresist $PR_2$ may be patterned to define openings 128 for forming pressure chambers 120, shown in FIG. 10C, and an opening (not shown) for forming an ink inlet 110, shown in FIG. 5.

Figure 10A:
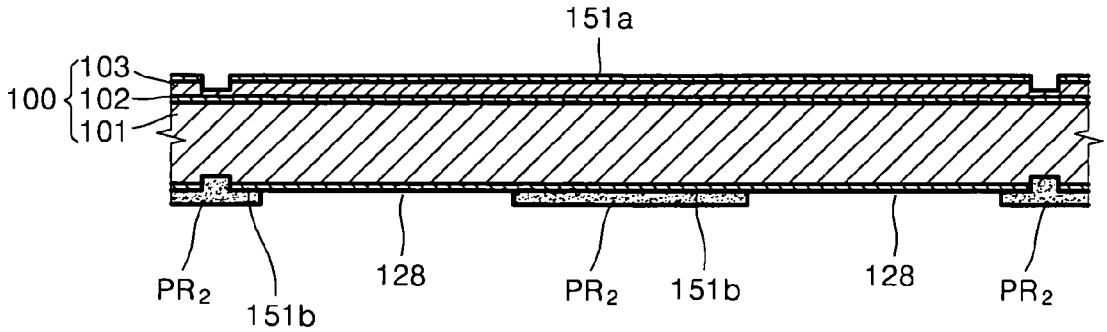
FIGS. 10A through 10D illustrate cross-sectional views of stages in a method of forming pressure chambers and an ink inlet in an upper substrate, according to an embodiment of the present invention.
Figure 10B:
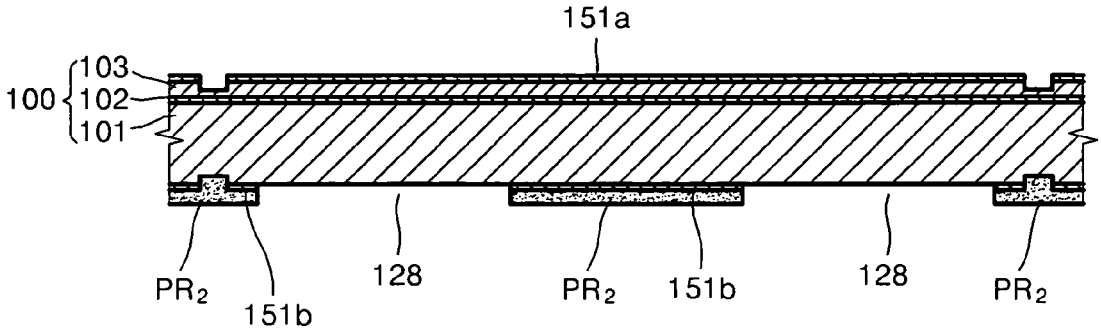

Referring to FIG. 10B, the photoresist $PR_2$ may be used as an etch mask to etch the silicon oxide layer 151*b* by a dry etching method, e.g., RIE, or a wet etching method, e.g., using BOE, in order to remove portions of the silicon oxide layer 151*b* exposed by the openings 128. As a result, the bottom surface of the upper substrate 100 may be partially exposed.

Figure 10C:
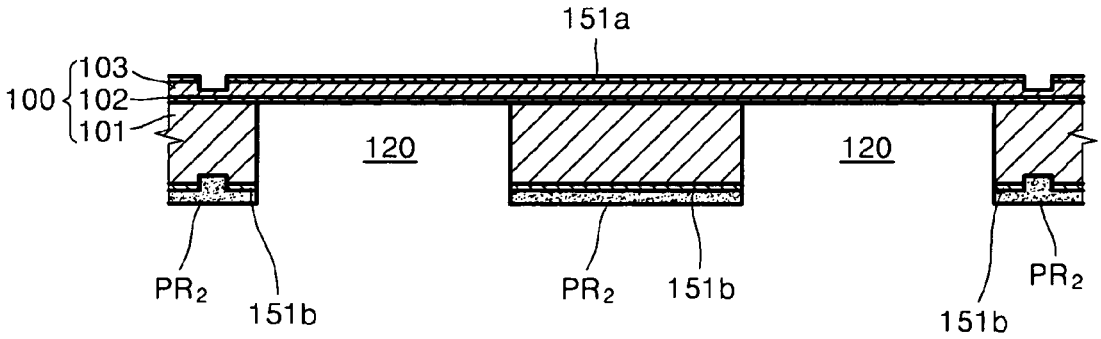

Referring to FIG. 10C, the exposed portions of the upper substrate 100 may be etched to a predetermined depth using the photoresist $PR_2$ as an etch mask, thereby forming pressure chambers 120. At this time, an ink inlet 110 may be partially formed in the upper substrate 100. The etching of the upper substrate 100 may be performed by a dry etching method, e.g., RIE using ICP.

When the upper substrate 100 is formed of an SOI wafer as shown, the intervening oxide layer 102 of the SOI wafer may function as an etch stop layer, such that only the first silicon layer 101 can be etched. Therefore, the pressure chambers 120 can be precisely formed at a desired depth by adjusting the thickness of the first silicon layer 101. The thickness of the first silicon layer 101 can be easily adjusted using CMP. Meanwhile, the second silicon layer 103 may form the upper wall of the pressure chambers 120 and function as a vibrating plate as described above, and the thickness of the second silicon layer 103 can be easily adjusted using CMP.

Figure 10D:
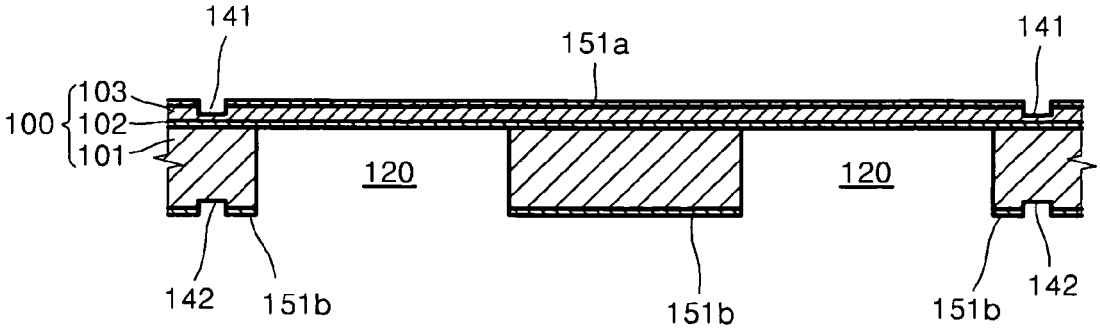

Referring to FIG. 10D, the photoresist $PR_2$ may be removed by the method described above, thereby forming the pressure chambers 120 and the ink inlet 110 (not shown) in the bottom surface of the upper substrate 100. The ink inlet 110 may be post-processed in a later process to vertically pass through the upper substrate 100 (described below).

As described above, the upper substrate 100 may be dry etched using the photoresist $PR_2$ as an etch mask and then the photoresist $PR_2$ may be removed. However, the upper substrate 100 can be dry etched using the silicon oxide layer 151*b* as an etch mask after the photoresist $PR_2$ is removed.

FIGS. 11A through 11J illustrate cross-sectional views of stages in a method of forming restrictors, a manifold, and dampers in the middle substrate 200.

Figure 11A:
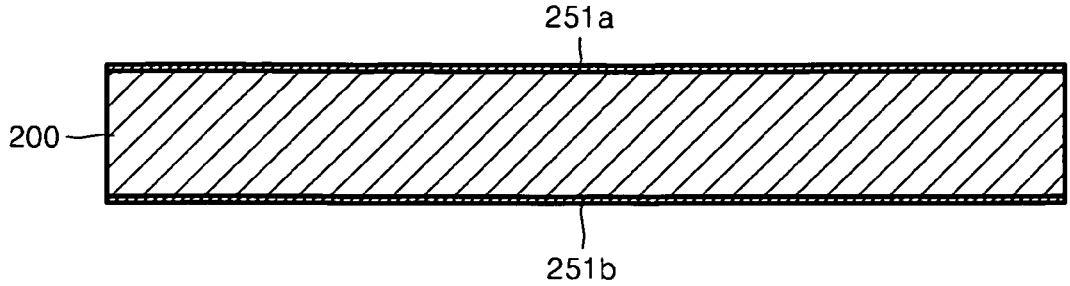
FIGS. 11A through 11J illustrate cross-sectional views of stages in a method of forming restrictors, a manifold and dampers in a middle substrate, according to an embodiment of the present invention.

Referring to FIG. 11A, the middle substrate 200 may be formed of a single crystal silicon wafer. First, a silicon wafer may be subjected to CMP to prepare the middle substrate 200 to have a thickness of about 200 μm to about 300 μm. The thickness of the middle substrate 200 may be determined according to the depth of a manifold 210, shown in FIG. 5, to be formed in a top surface of the middle substrate 200.

The middle substrate 200 may be wet and dry oxidized to form silicon oxide layers 251*a* and 251*b* on a top surface and a bottom surface of the middle substrate 200 to a thickness of about 5,000 Å to about 15,000 Å.

Figure 11B:
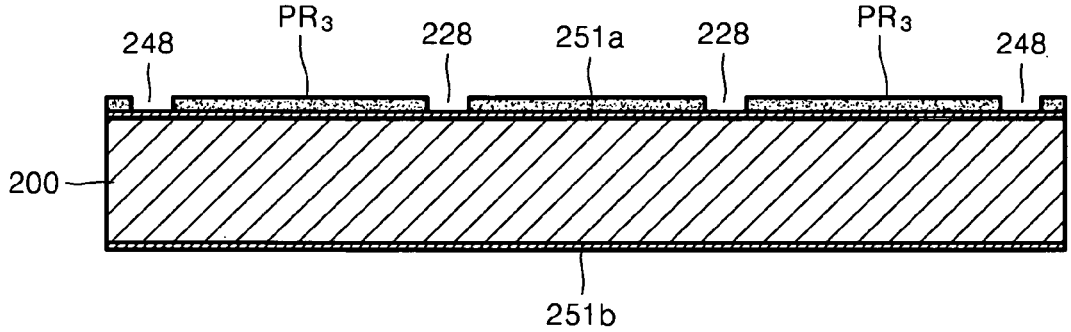

Referring to FIG. 11B, a photoresist $PR_3$ may be formed on the silicon layer 251*a* formed on the top surface of the middle substrate 200. Next, the photoresist $PR_3$ may be patterned to define openings 228 for forming restrictors 220, shown in FIG. 5, in the top surface of the middle substrate 200 and to define openings 248 for forming aligning marks. Although the aligning marks can be formed before the restrictors 220 are formed, the aligning marks may be simultaneously formed with the restrictors 220 to reduce manufacturing processes (described later).

Figure 11C:
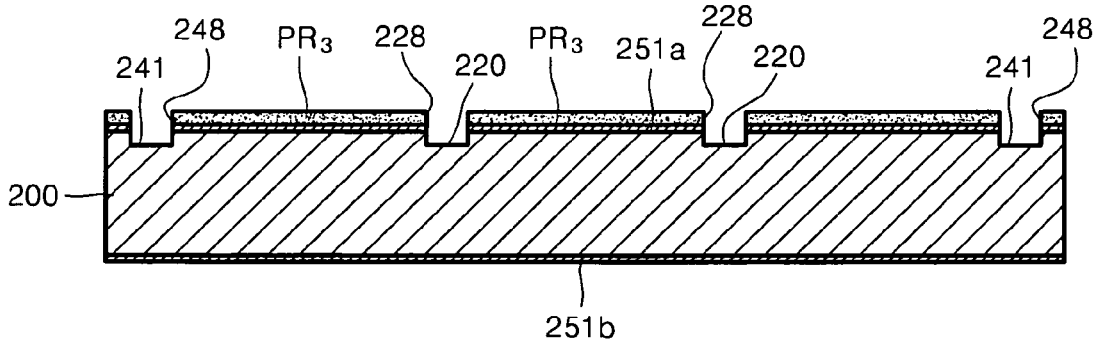

Referring to FIG. 11C, the patterned photoresist $PR_3$ may be used as an etch mask to etch portions of the silicon layer 251*a* exposed by the openings 228 and 248. Then, the middle substrate 200 may be etched to a predetermined depth, .e.g., about 20 μm to 40 μm, to form the restrictors 220 and aligning marks 241. Here, the silicon oxide layer 251*a* and the middle substrate 200 may be etched using the dry etching method or the wet etching method described above.

The photoresist $PR_3$ may be removed using the above-described method. The photoresist $PR_3$ may be removed after the silicon oxide layer 251*a* is etched. In this case, the silicon layer 251*a* is used as an etch mask for etching the middle substrate 200.

Figure 11D:
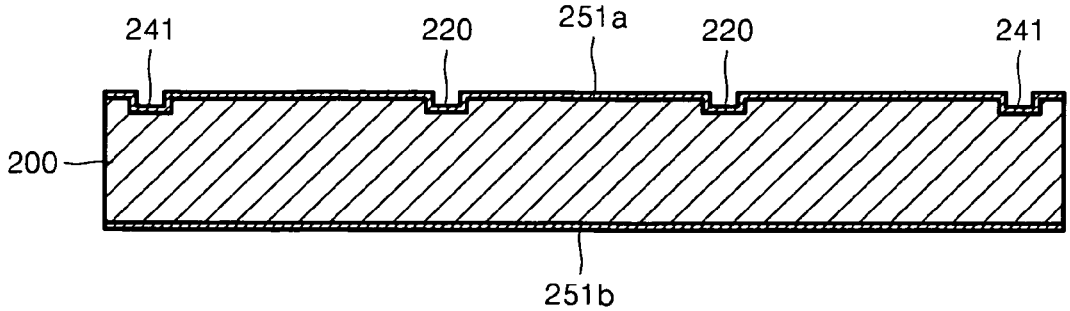

Referring to FIG. 11D, the middle substrate 200 may be cleaned using the above-described cleaning method, then the middle substrate 200 may be wet and dry oxidized to form silicon oxide layers 251*a* and 251*b* on the top and bottom surfaces of the middle substrate 200 again. Therefore, the silicon oxide layer can be formed inside the restrictors 220 and the aligning marks 241.

Figure 11E:
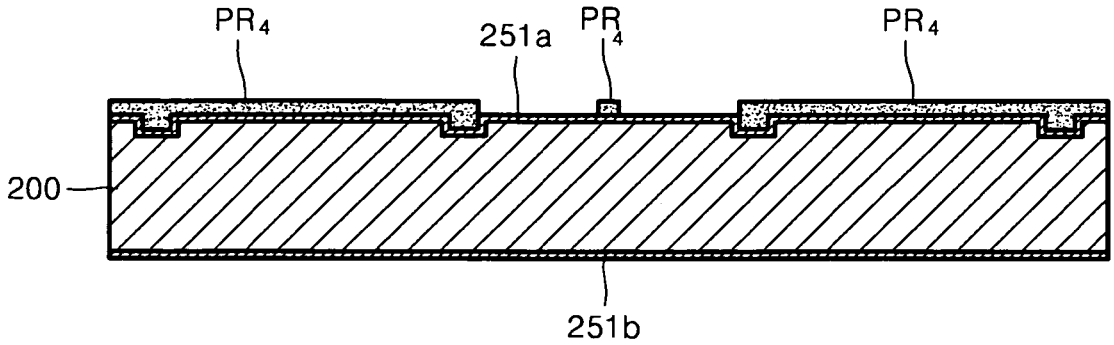
Figure 11F:
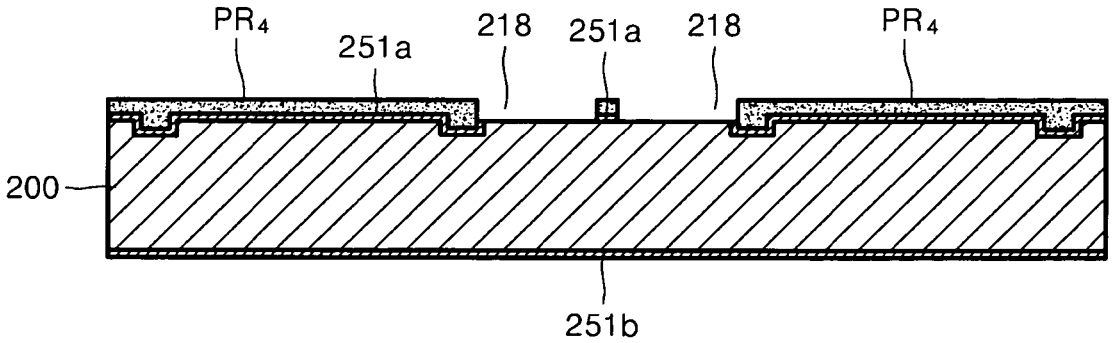

Referring to FIG. 11E, a photoresist $PR_4$ may be formed on the silicon oxide layer 251*a* formed on the top surface of the middle substrate 200, and the photoresist $PR_4$ may be patterned such that an opening 218, shown in FIG. 11F, for the manifold 210, shown in FIG. 5, may be formed on the top surface of the middle substrate 200. When the barrier rib 212, shown in FIG. 5, is formed in the manifold 210, a portion of the photoresist $PR_4$ corresponding to the barrier rib 212 may not be removed.

Referring to FIG. 11F, the silicon oxide layer 251*a* exposed by the opening 218 may be etched by the above-described wet or dry etching method using the photoresist $PR_4$ as an etch mask to partially expose the top surface of the middle substrate 200. After that, the photoresist $PR_4$ may be removed by the above-described method.

Figure 11G:
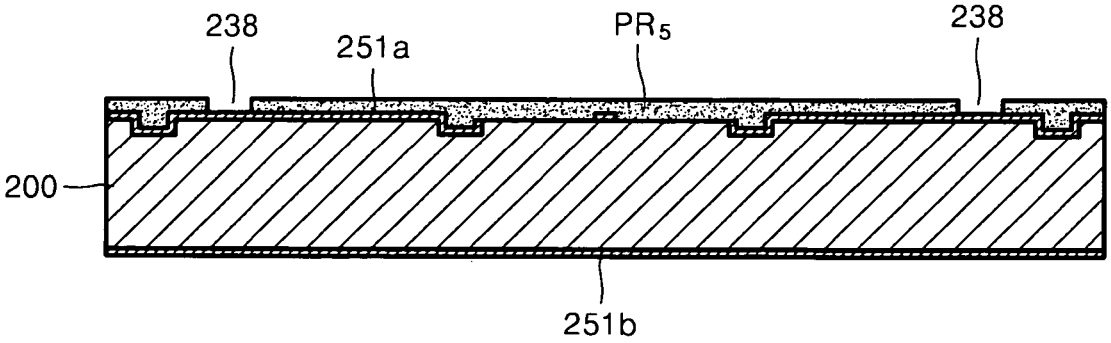

Referring to FIG. 11G, a photoresist $PR_5$ may be formed on the silicon oxide layer 251*a* formed on the top surface of the middle substrate 200. Here, the photoresist $PR_5$ may also be formed on the exposed top surface of the middle substrate 200. Then, the photoresist $PR_5$ may be patterned to form openings 238 for the dampers 230, shown in FIG. 5.

Figure 11H:
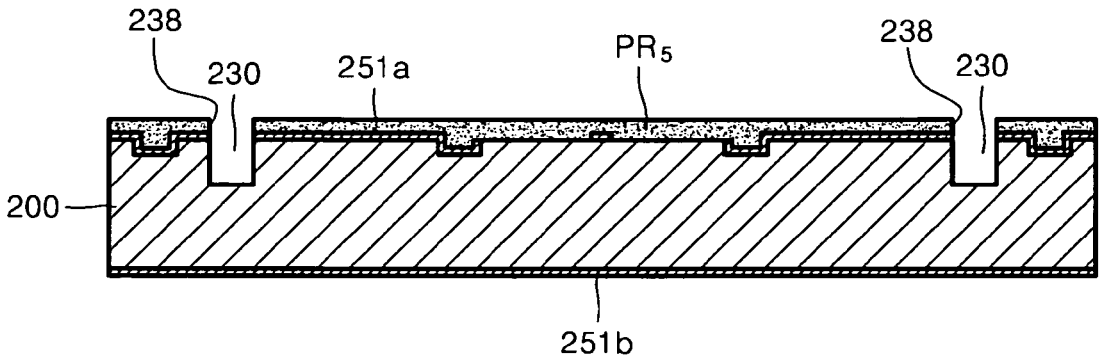

Referring to FIG. 11H, the silicon oxide layer 251*a* exposed by the openings 238 may be etched by the above-described dry or wet etching method using the photoresist $PR_5$ as an etch mask to partially expose the top surface of the middle substrate 200. Then, the exposed top surface of the middle substrate 200 may be etched to a predetermined depth to partially form the dampers 230. Here, the etched depth is determined depending on the difference between the thickness of the middle substrate 200 and the depth of the manifold 210. The etching of the middle substrate 200 may be performed by a dry etching method, e.g., RIE using ICP.

Figure 11I:
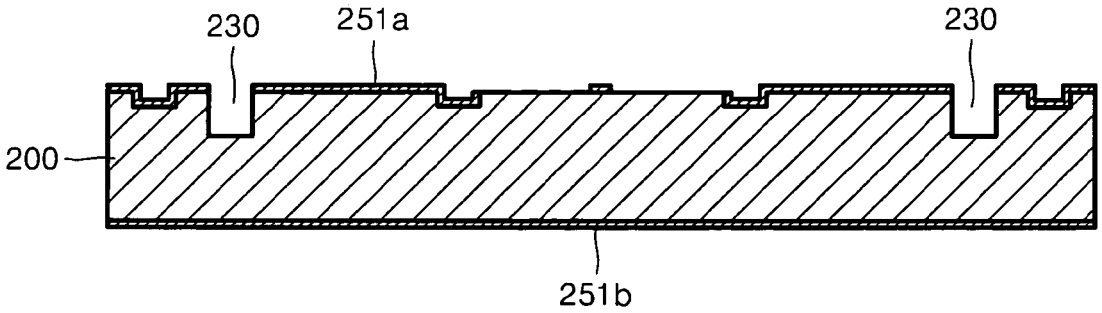

Referring to FIG. 11I, the photoresist $PR_5$ may be removed by the above-described method to expose a portion of the top surface of the middle substrate 200 for forming the manifold 210.

Figure 11J:
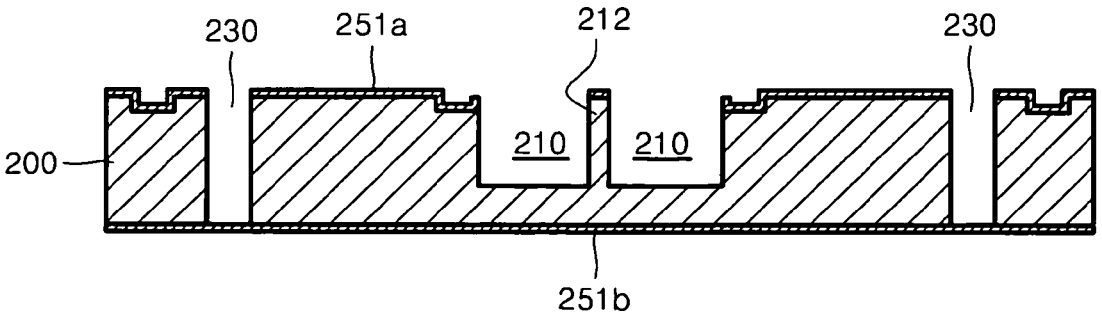

Referring to FIG. 11J, the exposed top surface portion of the middle substrate 200 and bottoms of the partially-formed dampers 230 are etched using the silicon oxide layer 251*a* as an etch mask to form the manifold 210 and the dampers 230. Here, the dampers 230 may pass through the middle substrate 200 in a vertical direction, and the manifold 210 may be formed to a predetermined depth from the top surface of the middle substrate 200. Further, the barrier rib 212 may be formed in the manifold 210 to divide the manifold 210 into right and left portions. The etching of the middle substrate 200 may also be performed by the dry etching method, .e.g., RIE using ICP.

Figure 12A:
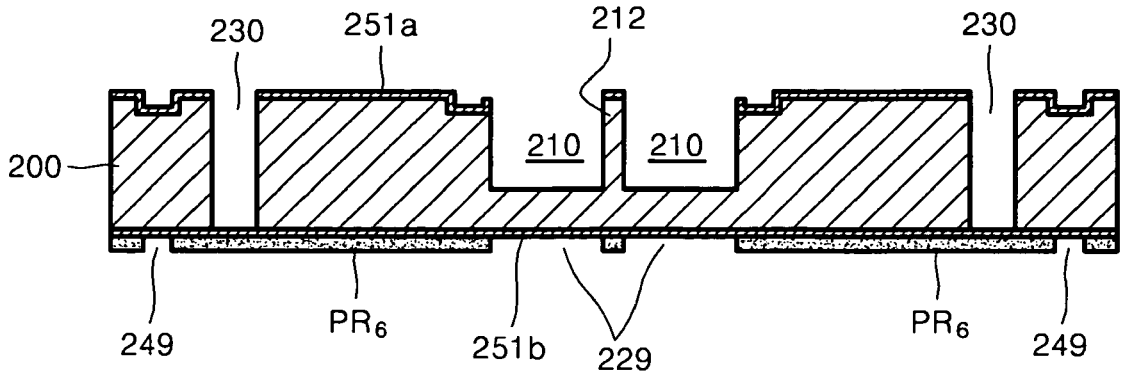
FIGS. 12A through 12C illustrate cross-sectional views of stages in a method of forming a damping membrane and a cavity in a middle substrate, according to an embodiment of the present invention.
Figure 12B:
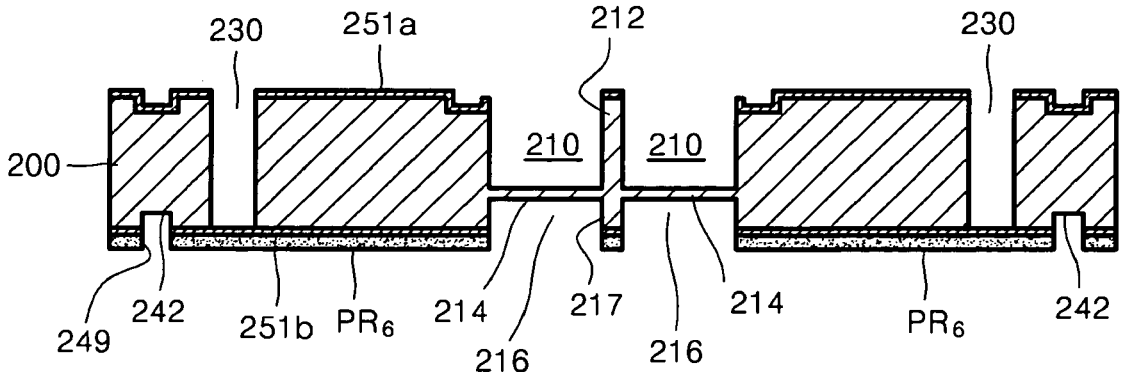
Figure 12C:
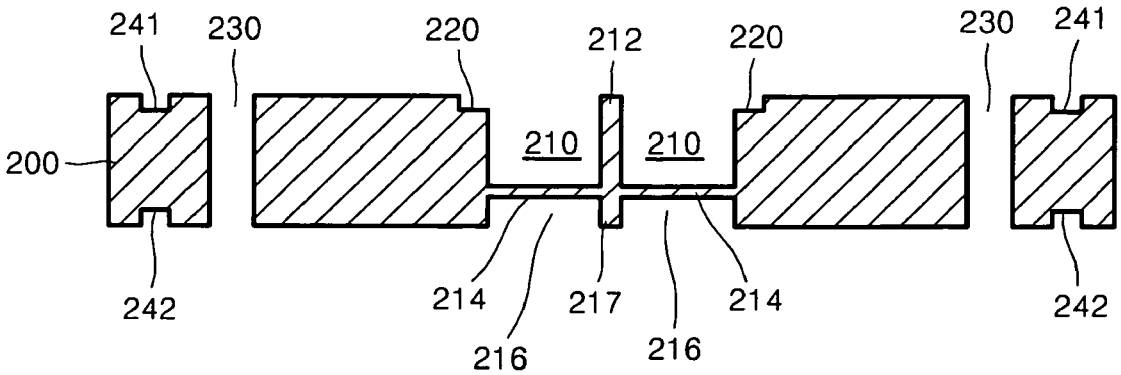

FIGS. 12A through 12C illustrate cross-sectional views of stages in a method of forming a damping membrane and a cavity in the middle substrate 200.

Referring to FIG. 12A, a photoresist $PR_6$ may be formed on the silicon oxide layer 251*b* formed on the bottom surface of the middle substrate 200. Next, the photoresist $PR_6$ may be patterned such that openings 229 and openings 249 may be formed on the silicon oxide layer 251*b* for the cavity 216, shown in FIG. 5, and aligning marks, respectively. When the supporting rib 217, shown in FIG. 5, is formed in the cavity 216, a portion of the photoresist $PR_6$ corresponding to the supporting rib 217 may not be removed when the photoresist $PR_6$ is patterned.

Referring to FIG. 12B, the silicon oxide layer 251*b* exposed by the openings 229 and 249 may be etched using the photoresist $PR_6$ as an etch mask, and the bottom surface of the middle substrate 200 may be etched to a predetermined depth to form a cavity 216 and aligning marks 242. Consequently, a damping membrane 214 may be formed between the cavity 216 and the manifold 210, and a supporting rib 217 may be formed in the cavity 216. Here, the damping membrane 214 formed under the manifold 210 may have a thickness of about 10 μm to about 20 μm. The silicon oxide layer 251*b* may be etched by the above-described dry or wet etching methods, and the middle substrate 200 may be etched by the dry etching method.

Thereafter, the photoresist $PR_6$ may be removed by the above-described method. The photoresist $PR_6$ may be removed after the silicon oxide layer 251*b* is etched. In this case, the silicon oxide layer 251*b* may be used as an etch mask for etching the middle substrate 200.

Referring to FIG. 12C, the remaining silicon oxide layers 251*a* and 251*b* may be removed by wet etching, completely forming the middle substrate 200 with the damping membrane 214 and the cavity 216.

As described above, according to the present invention, the cavity 216 and the damping membrane 214 may be formed in the bottom surface of the middle substrate 200 together with the aligning marks 242. Therefore, an additional process is not required to form the cavity 216 and the damping membrane 214.

Meanwhile, the cavity 216 and the damping membrane 214 can be formed in the bottom surface of the middle substrate 200 before the restrictors 220, the manifold 210, and the dampers 230 may be formed in the top surface of the middle substrate 200.

The cavity 216 may have substantially the same width as the manifold 210 as shown in FIG. 6, or a larger width than the manifold 210 as shown in FIG. 8A.

Further, the cavity 216 can be formed in the top surface of the lower substrate 300 to a predetermined depth as shown in FIG. 8B. In this case, the cavity 216 may be formed in the top surface of the lower substrate 300 together with aligning marks 341.

Furthermore, as shown in FIG. 8C, the cavity 216 can be formed in the bottom surface of the middle substrate 200 and the top surface of the lower substrate 300.

Figure 13:
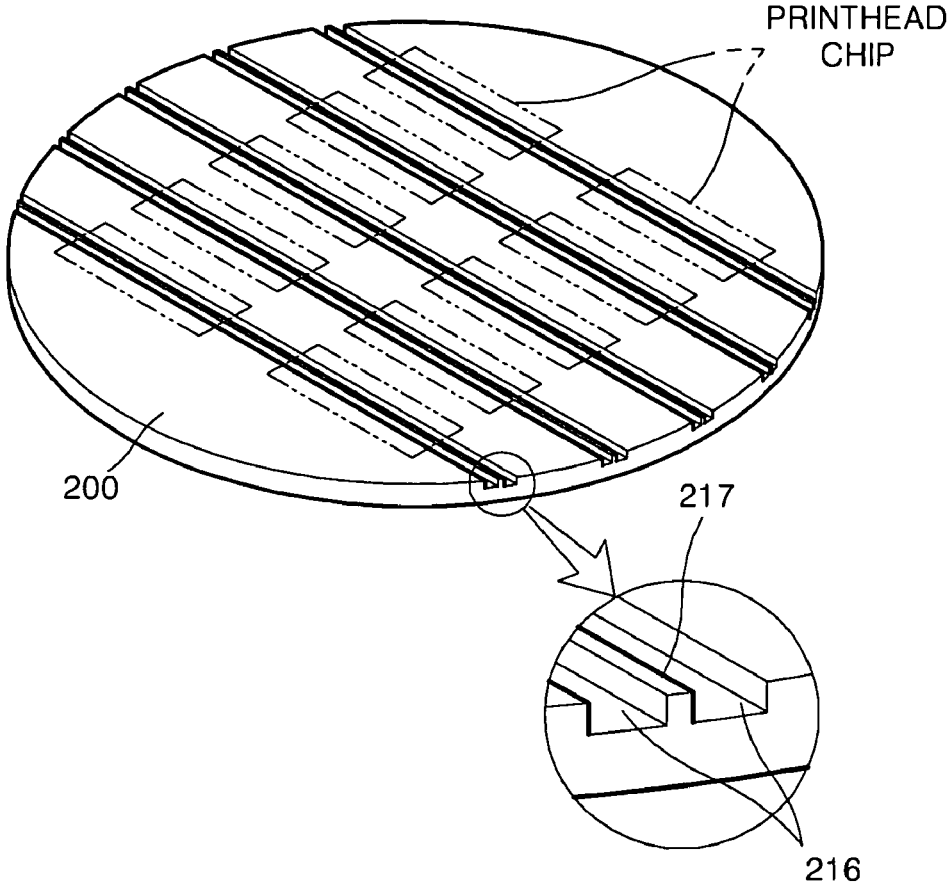
FIG. 13 illustrates a perspective view of the cavity formed on a bottom of the middle substrate in the process depicted in FIGS. 12A through 12C.

FIG. 13 illustrates a perspective view showing the cavity 216 formed on the bottom of the middle substrate 200 in the process depicted in FIGS. 12A through 12C.

Referring to FIG. 13, the inkjet printhead of the present invention is formed using silicon wafers in the form of a number of chips. Therefore, the cavity 216 may be formed to extend to the edge of a silicon wafer for the middle substrate 200 in the process shown in FIGS. 12A through 12C. In this case, gas generated when the middle substrate 200 and the lower substrate 300 are bonded can be easily discharged to the outside through the cavity 216. This will be more fully described in connection with the bonding process.

FIGS. 14A through 14G illustrate cross-sectional views of stages of a method of forming nozzles in a lower substrate, according to an embodiment of the present invention.

Figure 14A:
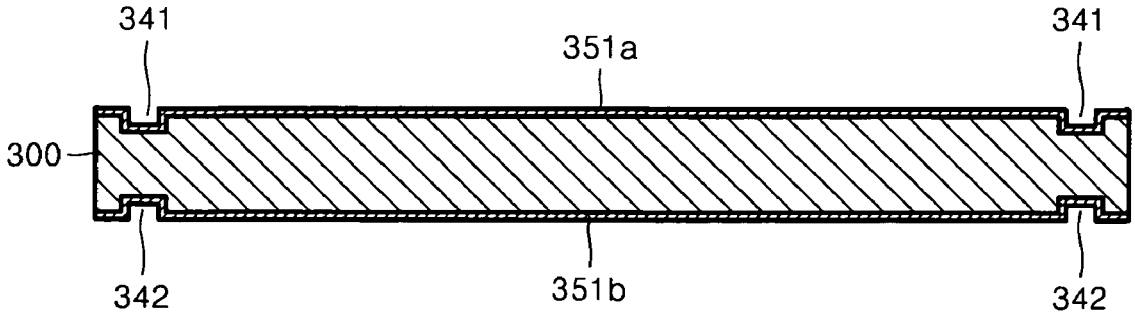
FIGS. 14A through 14G illustrate cross-sectional views of stages in a method of forming nozzles in a lower substrate, according to an embodiment of the present invention.

Referring to FIG. 14A, a lower substrate 300 may be formed of a single crystal silicon wafer according to an embodiment of the present invention. First, a silicon wafer may be subjected to CMP to obtain a thickness of about 100 μm to about 200 μm for the lower substrate 300.

The lower substrate 300 may be wet and dry oxidized to form silicon oxide layers 351*a* and 351*b* on a top surface and a bottom surface of the lower substrate 300 to a thickness of about 5,000 Å to 15,000 Å. Then, aligning marks 341 and 342 may be formed on the top and bottom surface of the lower substrate 300. The aligning marks 341 and 342 may be formed by the same method shown in FIGS. 9A through 9D.

Figure 14B:
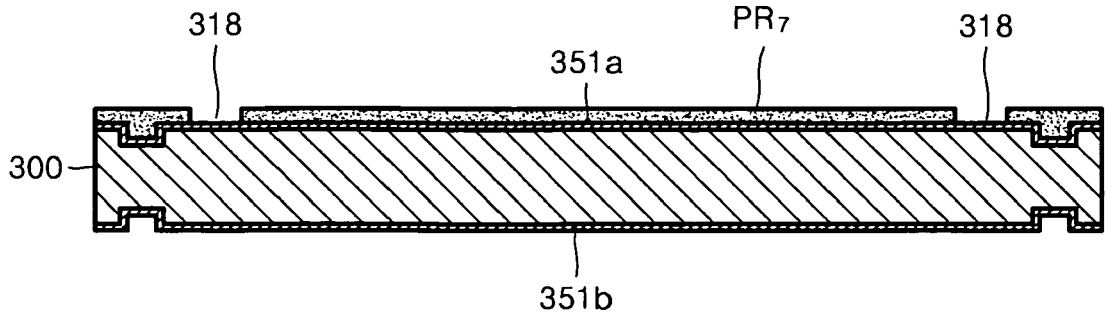
Figure 14C:
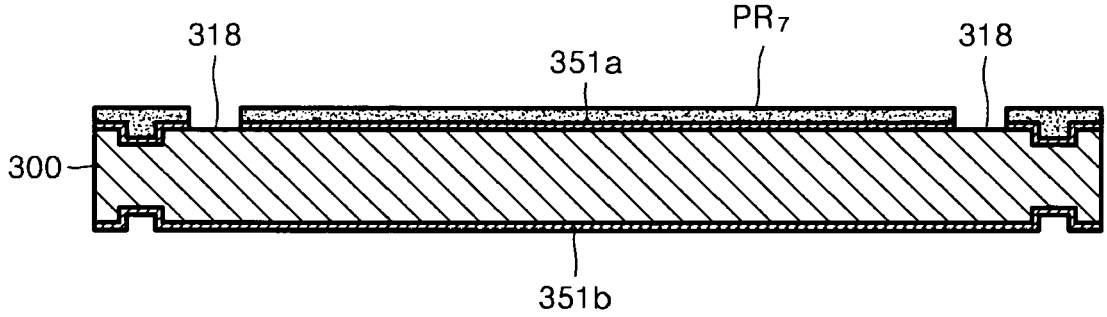

Referring to FIG. 14B, a photoresist $PR_7$ may be formed on the silicon layer 351*a* formed on the top surface of the lower substrate 300, and the photoresist $PR_7$ may be patterned to form openings 318 on the top surface of the lower substrate 300 for the ink introducing portions 311 of the nozzles 310, shown in FIG. 5.

Referring to 14C, the photoresist $PR_7$ may be used as an etch mask to etch the silicon oxide layer 351*a* exposed by the openings 318 to partially expose the top surface of the lower substrate 300. Here, the etching of the silicon oxide layer 351*a* may be performed by the dry or wet etching as described above. Then, the photoresist $PR_7$ may be removed, and the lower substrate 300 may be cleaned, e.g., by an acid cleaning method using sulfuric acid, BOE, etc.

Figure 14D:
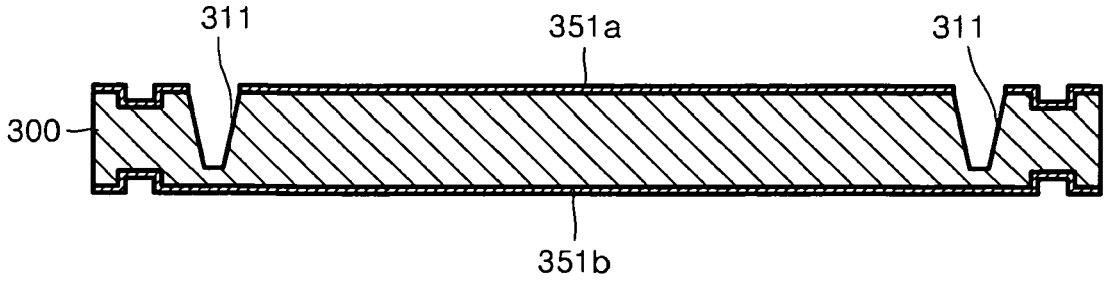

Referring to FIG. 14D, the exposed top surface of the lower substrate 300 may be etched to a predetermined depth using the silicon oxide layer 351*a* as an etch mask, thereby forming an ink introducing portions 311 of nozzles. The etching of the lower substrate 300 may be performed by a wet etching method using silicon etchant such as TMAH or KOH. In this case, the ink introducing portions 311 may be formed into a pyramid shape by the anisotropic wet etching characteristic of the lower substrate 300, i.e., etching along the crystal planes in the lower substrate 300.

Figure 14E:
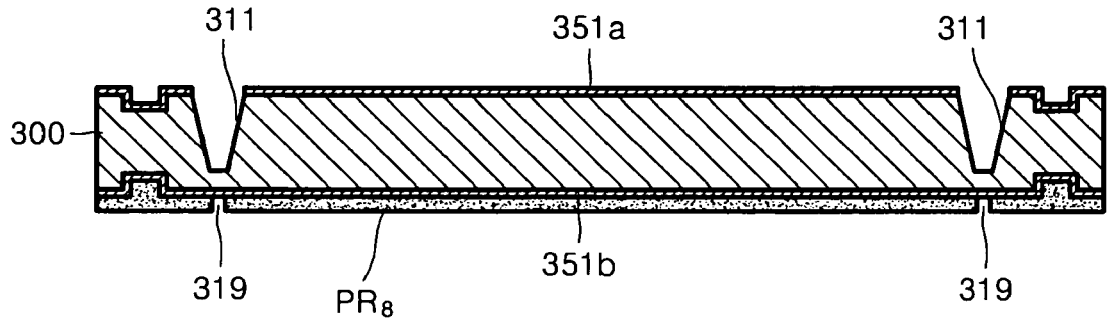

Referring to FIG. 14E, a photoresist $PR_8$ may be formed on the silicon oxide layer 351*b* formed on the bottom surface of the lower substrate 300, and the photoresist $PR_8$ may be patterned to form openings 319 on the bottom surface of the lower substrate 300 for the ink ejecting holes 312 of the nozzles.

Figure 14F:
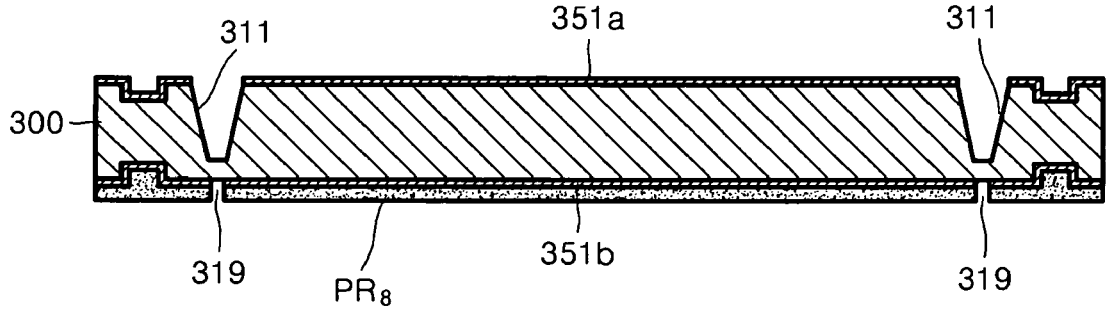

Referring to FIG. 14F, the silicon oxide layer 351*b* exposed by the openings 319 may be wet or dry etched using the photoresist $PR_8$ as an etch mask to partially expose the bottom surface of lower substrate 300, and then the photoresist $PR_8$ may be removed.

Figure 14G:
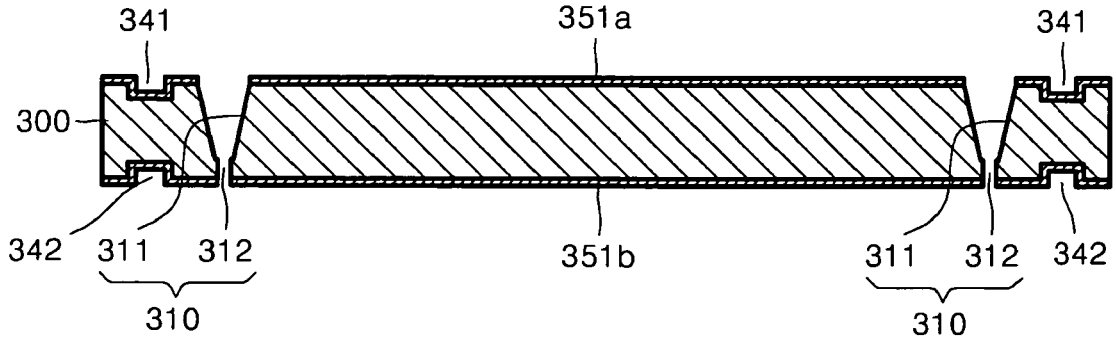

Referring to FIG. 14G, the exposed bottom surface of the lower substrate 300 may be etched using the silicon oxide layer 351*b* as an etch mask until the lower substrate 300 is penetrated, thereby forming ink ejecting holes 312 communicating with the ink introducing portions 311. Here, the etching of the lower substrate 300 may be performed by a dry etching method such as RIE using ICP.

In this way, the lower substrate 300 can be completely formed with the nozzles 310 having the ink introducing portions 311 and the ink ejecting holes 312.

Figure 15:
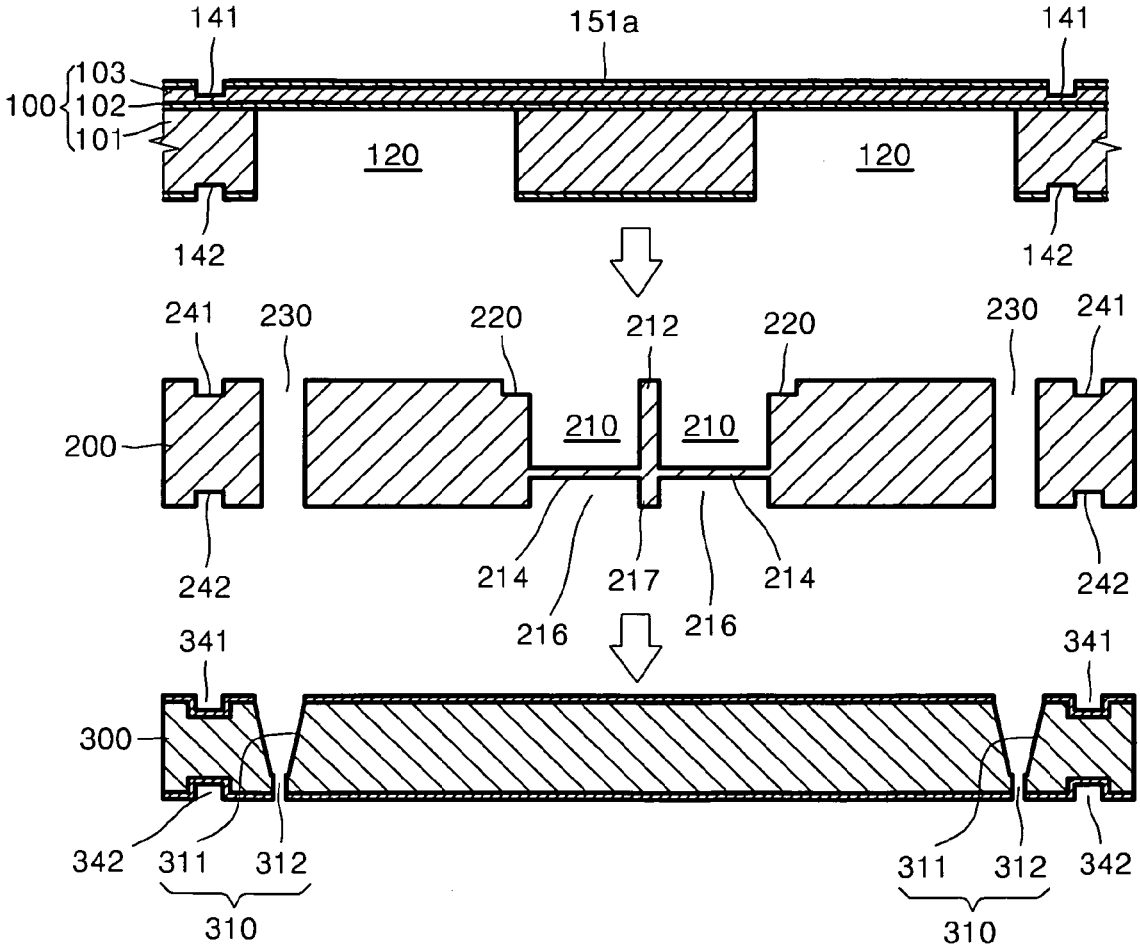
FIG. 15 illustrates an exploded cross-sectional view of a process of sequentially stacking and bonding a lower substrate, a middle substrate and an upper substrate, according to an embodiment of the present invention.

FIG. 15 illustrates a cross-sectional exploded view of sequentially stacking and bonding the lower substrate 300, the middle substrate 200, and the upper substrate 100, according to an embodiment of the present invention.

Referring to FIG. 15, the lower substrate 300, the middle substrate 200 and the upper substrate 100 formed as described above may be sequentially stacked and bonded together. The aligning marks 141, 142, 241, 242, 341, 342 of the three substrates 100, 200, and 300 may be used to precisely align the three substrates 100, 200 and 300. Once aligned, the three substrates 100, 200, and 300 may be bonded together, e.g., by well-known silicon direct bonding (SDB).

Generally, in SDB, silicon wafers to be bonded are cleaned first. By the cleaning, thin layers having ions and molecules, e.g., OH—, H+, $H_2O$, $H_2$, $O_2$, are formed on the surfaces of the silicon wafers. Next, the silicon wafers are brought into contact with each other by pressure to pre-bond the silicon wafers by the Van der Waals's force between the ions and molecules. Next, the pre-bonded silicon wafers are heated to a temperature of about 100° C. in a heat treatment furnace to bond the silicon wafers strongly by the interdiffusion of atoms between the silicon wafers. During the heat treatment, gas is generated by the ions and molecules of the silicon wafers.

However, according to the present invention, if the cavity 216 extends to the edge of the inkjet printhead, in this embodiment in the middle substrate 200 as shown in FIG. 13, gas generated during the bonding process of the middle substrate 200 and the lower substrate 300 can be easily discharged through the cavity 216. Therefore, voids resulting from the gas can be prevented or minimized between the middle substrate 200 and the lower substrate 300.

Figure 16:
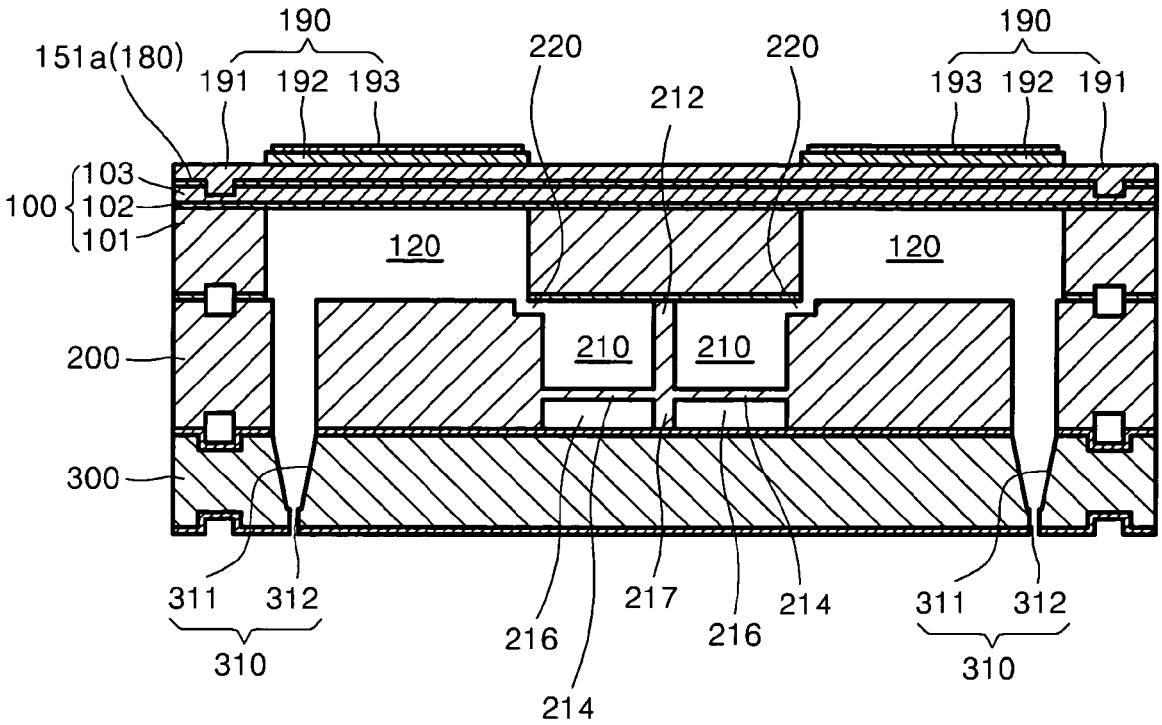
FIG. 16 illustrates a cross-sectional view of the piezoelectric inkjet printhead of FIG. 15 with piezoelectric actuators formed on an upper substrate.

FIG. 16 illustrates a cross-sectional view of a piezoelectric actuator on the upper substrate 100 of the piezoelectric inkjet printhead, according to an embodiment of the present invention.

Referring to FIG. 16, when the lower substrate 300, the middle substrate 200, and the upper substrate 100 are sequentially stacked and bonded together, a silicon oxide layer 180 may be formed on the top surface of the upper substrate 100 as an insulating layer. However, since the silicon oxide layer 151*a* is already formed on the top surface of the upper substrate 100 when the upper substrate 100 is formed, the silicon oxide layer 151*a* may be used as the silicon oxide layer 180 instead of forming the silicon oxide layer 180.

Next, a lower electrode 191 of piezoelectric actuators is formed on the silicon oxide layer 180. The lower electrode 191 may include two thin metal layers formed of titanium (Ti) and platinum (Pt). In this case, the lower electrode 191 may be formed by sputtering Ti and Pts onto the entire surface of the silicon oxide layer 180 to a predetermined thickness.

Next, piezoelectric layers 192 and upper electrodes 193 may be formed on the lower electrode 191. Specifically, piezoelectric paste may be applied to the lower electrode 191 above the pressure chambers 120 to a predetermined thickness by using a screen printing method, and it is dried for a predetermined time to form the piezoelectric layers 192. Various piezoelectric materials can be used for the piezoelectric layers 192. Generally, PZT ceramic may be used for the piezoelectric layers 192. Thereafter, an electrode material, e.g., Ag—Pd paste, may be printed on the dried piezoelectric layers 192 to form the upper electrodes 193. Next, the piezoelectric layers 192 and the upper electrodes 193 may be sintered at a predetermined temperature, e.g., about 900 to 1,000° C. Then, an electric field is applied to the piezoelectric layers 192 to activate the piezoelectric characteristic of the piezoelectric layers 192 (polling treatment). In this way, piezoelectric actuators 190 having the lower electrode 191, the piezoelectric layers 192 and the upper electrodes 193 are formed on the upper substrate 100.

Then, the ink inlet 110, shown in FIG. 5, which is partially formed in the bottom surface of the upper substrate 100 to a predetermined depth when the pressure chambers 120 are formed in the bottom surface of the upper substrate 100 in the process shown in FIGS. 10A through 10D, may be post-processed to pass through the upper substrate 100. For example, a thin portion of the upper substrate 100 located above the ink inlet 110 can be removed using an adhesive tape to allow the ink inlet 110 to pass through the upper substrate 100.

In this way, the piezoelectric inkjet printhead of the present invention can be formed.

As described above, according to the present invention, the damping membrane may be formed under the manifold to dampen a sudden pressure change inside the manifold, so that cross-talk can be effectively prevented when ink is ejected. Therefore, ink can be uniformly ejected through a number of nozzles, and thereby printing quality can be improved.

Further, the damping membrane is protected by the lower substrate and is not exposed to the outside, so that the damping membrane can be prevented from being damaged or broken by external objects.

Furthermore, gas generated when the substrates are bonded can be smoothly discharged to the outside through the cavity formed under the damping membrane, so that voids generating between the substrates by the gas can be prevented. Therefore, defective products can be reduced and yield can be increased in manufacturing the piezoelectric inkjet printhead.

In addition, the damping membrane and the cavity may be formed simultaneously with the aligning marks in the bottom surface of the middle substrate, so that an additional process is not required for the damping membrane and the cavity.

Exemplary embodiments of the present invention have been disclosed herein, and although specific terms are employed, they are used and are to be interpreted in a generic and descriptive sense only and not for purpose of limitation. For example, the processes described for elements of the printhead of the present invention are exemplary ones, and thus various other processes including etching can be applied to the present invention. Further, the process or procedures can be performed in a different order. Accordingly, it will be understood by those of ordinary skill in the art that various changes in form and details may be made without departing from the spirit and scope of the present invention as set forth in the following claims.

What is claimed is:

1. A piezoelectric inkjet printhead, comprising:

an ink inlet for allowing inflow of ink;

a plurality of pressure chambers to contain ink to be ejected, the plurality of pressure chambers being in communication with the ink inlet;

a manifold formed in communication with the ink inlet;

a plurality of restrictors connecting the manifold to respective first ends of the pressure chambers;

a plurality of dampers at positions corresponding to respective second ends of the pressure chambers, the second ends being opposite the first ends;

a plurality of nozzles in communication with the plurality of dampers for ejecting the ink;

a plurality of actuators for applying a driving force to each of the pressure chambers for ejecting the ink;

a damping membrane under the manifold for dampening a pressure change inside the manifold;

a cavity under the damping membrane; and a supporting rib in the cavity along a length direction of the cavity.

2. The piezoelectric inkjet printhead as claimed in claim 1, wherein the damping membrane has a thickness of about 10 μm to about 20 μm.

3. The piezoelectric inkjet printhead as claimed in claim 1, wherein the cavity extends to an edge of the printhead.

4. The piezoelectric inkjet printhead as claimed in claim 3, wherein the cavity is in communication with an ambient atmosphere.

5. The piezoelectric inkjet printhead as claimed in claim 4, wherein:

the printhead has an opening in the edge thereof, and the opening couples the cavity to the ambient atmosphere.

6. The piezoelectric inkjet printhead as claimed in claim 1, wherein the cavity has substantially the same width as the manifold.

7. The piezoelectric inkjet printhead as claimed in claim 1, wherein the cavity has a width larger than the manifold.

8. The piezoelectric inkjet printhead as claimed in claim 1, wherein:

the ink inlet and the plurality of pressure chambers are in an upper substrate, the manifold, the plurality of restrictors, the plurality of dampers and the damping membrane are in a middle substrate, the plurality of nozzles are in a lower substrate, and the cavity is in at least one of a bottom surface of the middle substrate and a top surface of the lower substrate.

9. The piezoelectric inkjet printhead as claimed in claim 8, wherein the cavity extends to an edge of the at least one of the bottom surface of the middle substrate and the top surface of the lower substrate.

10. The piezoelectric inkjet printhead as claimed in claim 8, wherein a full extent of the cavity is defined in one of the middle substrate and the lower substrate.

11. The piezoelectric inkjet printhead as claimed in claim 1, further comprising:

a barrier rib in the manifold along a length direction of the manifold in correspondence with the supporting rib.

12. The piezoelectric inkjet printhead as claimed in claim 1, wherein the supporting rib in the cavity is in contact with the damping membrane.

13. A piezoelectric inkjet printhead, comprising:

an ink inlet for allowing inflow of ink;

a plurality of pressure chambers to contain ink to be ejected, the plurality of pressure chambers being in communication with the ink inlet;

a manifold formed in communication with the ink inlet;

a barrier rib in the manifold along a length direction of the manifold;

a plurality of restrictors connecting the manifold to respective first ends of the pressure chambers;

a plurality of dampers at positions corresponding to respective second ends of the pressure chambers, the second ends being opposite the first ends;

a plurality of nozzles in communication with the plurality of dampers for ejecting the ink;

a plurality of actuators for applying a driving force to each of the pressure chambers for ejecting the ink; and means for dampening a pressure change inside the manifold including a cavity and a supporting rib in the cavity along a length direction of the cavity in correspondence with the barrier rib.

14. The piezoelectric inkjet printhead as claimed in claim 13, wherein the means for dampening comprises:

a damping membrane under the manifold;

wherein the cavity is located under the damping membrane.

15. The piezoelectric inkjet printhead as claimed in claim 14, wherein the supporting rib in the cavity is in contact with the damping membrane.

16. The piezoelectric inkjet printhead as claimed in claim 13, wherein the cavity is in communication with an ambient atmosphere.

17. The piezoelectric inkjet printhead as claimed in claim 16, wherein:

the printhead has an opening in an edge thereof, and the opening couples the cavity to the ambient atmosphere.

18. A method of manufacturing a piezoelectric inkjet printhead, comprising:

forming an ink inlet allowing inflow of ink;

forming a plurality of pressure chambers to contain ink to be ejected;

forming a manifold in communication with the ink inlet;

forming a plurality of restrictors connecting the manifold to respective first ends of the pressure chambers;

forming a plurality of dampers at positions corresponding to respective second ends of the pressure chambers, the second ends being opposite the first ends;

forming a damping membrane under the manifold for dampening pressure change inside the manifold;

forming a cavity under the damping membrane;

forming a supporting rib in the cavity along a length direction of the cavity;

forming a plurality of nozzles for ejecting the ink; and forming a plurality of piezoelectric actuators for providing a driving force for ejecting the ink.

19. The method as claimed in claim 18, wherein the damping membrane has a thickness of about 10 μm to about 20 μm.

20. The method as claimed in claim 18, wherein the cavity extends to an edge of the printhead.

21. The method as claimed in claim 20, wherein the cavity is in communication with an ambient atmosphere.

22. The method as claimed in claim 21, wherein:

the printhead is formed with an opening in the edge thereof, and the opening couples the cavity to the ambient atmosphere.

23. The method as claimed in claim 18, wherein the cavity has substantially the same width as the manifold.

24. The method as claimed in claim 18, wherein the cavity has a width larger than the manifold.

25. The method as claimed in claim 18, further comprising:

forming a barrier rib in the manifold along a length direction of the manifold in correspondence with the supporting rib.

26. The method as claimed in claim 18, wherein:

forming the ink inlet and the plurality of pressure chambers includes processing an upper silicon substrate, forming the manifold, the plurality of restrictors, the plurality of dampers and the damping membrane includes processing a middle silicon substrate, forming the plurality of nozzles includes processing a lower silicon substrate, and forming the cavity includes processing at least one of the middle and lower substrates.

27. The method as claimed in claim 26, wherein each of processing of the middle substrate and processing of the lower substrate comprises forming an aligning mark for using the aligning mark as an aligning reference in stacking and bonding the lower substrate and the middle substrate, and the cavity is simultaneously formed with the aligning mark in at least one of the middle substrate and the lower substrate.

28. The method as claimed in claim 27, wherein forming the cavity and the aligning mark comprises:

forming a silicon oxide layer on at least one surface of the bottom surface of the middle substrate and the top surface of the lower substrate;

forming a photoresist on the silicon oxide layer and patterning the photoresist to form openings for the cavity and the aligning mark;

etching the silicon oxide layer exposed through the openings to expose the at least one surface; and etching the at least one surface exposed by the etching of the silicon oxide layer to a predetermined depth to form the cavity and the aligning mark.

29. The method as claimed in claim 18, wherein the supporting rib in the cavity is in contact with the damping membrane.

30. A method of manufacturing a piezoelectric inkjet printhead, comprising:

providing lower, middle and upper silicon substrates;

processing the upper silicon substrate including the following, forming an ink inlet allowing inflow of ink, and forming a plurality of pressure chambers to contain ink to be ejected;

processing the middle silicon substrate including the following, forming a manifold in communication with the ink inlet, forming a plurality of restrictors connecting the manifold to respective first ends of the pressure chambers, forming a plurality of dampers at positions corresponding to respective second ends of the pressure chambers, the second ends being opposite the first ends, and forming a damping membrane under the manifold for dampening pressure change inside the manifold;

processing the lower silicon substrate including forming a plurality of nozzles for ejecting the ink;

processing at least one of the middle substrate and the lower substrate including forming a cavity under the damping membrane; and forming a plurality of piezoelectric actuators for providing a driving force for ejecting the ink;

wherein forming the cavity includes the following, forming a silicon oxide layer on at least one surface of a bottom surface of the middle substrate and a top surface of the lower substrate, forming a photoresist on the silicon oxide layer and patterning the photoresist to form an opening for the cavity, etching the silicon oxide layer exposed through the opening to expose the at least one surface, and etching the at least one surface exposed by the etching of the silicon oxide layer to a predetermined depth to form the cavity.

* * * * *